US011197508B2

(12) United States Patent
Votolato et al.

(10) Patent No.: US 11,197,508 B2
(45) Date of Patent: Dec. 14, 2021

(54) ADJUSTABLE FACE SHIELD PROVIDING A RANGE OF PROTECTIVE FEATURES

(71) Applicant: Spellbound Development Group, Inc., Irvine, CA (US)

(72) Inventors: Earl Joseph Votolato, Newport Beach, CA (US); Ryan Michael Burkes, Huntington Beach, CA (US); Carlos David Reyes, Rancho Santa Margarita, CA (US)

(73) Assignee: Spellbound Development Group, Inc., Irvine, CA (US)

( * ) Notice: Subject to any disclaimer, the term of this patent is extended or adjusted under 35 U.S.C. 154(b) by 0 days.

(21) Appl. No.: 16/890,729

(22) Filed: Jun. 2, 2020

(65) Prior Publication Data

US 2021/0315291 A1 Oct. 14, 2021

Related U.S. Application Data

(60) Provisional application No. 63/027,511, filed on May 20, 2020, provisional application No. 63/007,082, filed on Apr. 8, 2020.

(51) Int. Cl.
*A41D 13/11* (2006.01)
*A42B 1/245* (2021.01)

(52) U.S. Cl.
CPC ..... *A41D 13/11* (2013.01); *A42B 1/245* (2013.01)

(58) Field of Classification Search
CPC ..... A41D 13/11; A41D 13/1107; A41D 13/1123; A41D 13/1161; A41D 13/1184; A42B 1/245; A42B 1/247; A42B 1/02; A42B 3/18; A42B 3/185; A42B 3/20; A42B 3/22; A42B 3/221; A42B 3/222; A42B 3/225; A42B 1/062; A42B 3/04; A42B 1/064; A42B 3/0406; A42B 3/226; A42B 1/061; G02C 3/02; A61F 9/025; A61F 9/029; A61F 9/06
USPC ..... 2/9, 15, 10, 6.3, 6.4, 6.5, 6.7, 424, 2/209.13, 453, 12, 173; 351/155
See application file for complete search history.

(56) References Cited

U.S. PATENT DOCUMENTS 2,248,331 A * 7/1941 Blodjer ..... A42B 1/062 2/10
6,102,033 A * 8/2000 Baribeau ..... A62B 18/08 128/201.24
2008/0001735 A1* 1/2008 Tran ..... G06F 19/00 340/539.22

(Continued)

FOREIGN PATENT DOCUMENTS

DE 202020101562 U1 * 4/2020 ..... A41D 13/1161

*Primary Examiner* — F Griffin Hall
(74) *Attorney, Agent, or Firm* — Sheridan Ross P.C.

(57) ABSTRACT

Methods and systems are provided for a face shield capable of sliding onto a brim of a head covering. The face shield may have coatings providing anti-microbial protection, UV protection, fire protection, or combinations thereof. The face shield may be pre-designed for a specific head covering, or may be adaptable to take the correct shape upon mounting to the head covering. The face shield may also include a snap-on strip that is releasably connectable to a substantially transparent sheet of material forming the face shield and the snap-on strip may be configured to impart a shape to the substantially transparent sheet of material when connected thereto.

8 Claims, 20 Drawing Sheets

(56) References Cited

U.S. PATENT DOCUMENTS

| | | | | |
|---|---|---|---|---|
| 2013/0031693 | A1* | 2/2013 | Gleason | A42B 3/225 2/9 |
| 2016/0066643 | A1* | 3/2016 | Squair | A42B 3/225 2/424 |
| 2020/0281301 | A1* | 9/2020 | Wynalda, Jr. | A42B 3/225 |

* cited by examiner

ADJUSTABLE FACE SHIELD PROVIDING A RANGE OF PROTECTIVE FEATURES

CROSS-REFERENCE TO RELATED APPLICATION

This application claims the benefit of priority under 35 U.S.C. § 119(e) to U.S. Provisional Patent Application Nos. 63/027,511, filed May 20, 2020, and 63/007,082, filed Apr. 8, 2020, the entireties of which are hereby incorporated herein by reference.

FIELD

The present disclosure is generally directed to protective gear and, in particular, toward facial protective gear.

BRIEF SUMMARY OF THE INVENTION

An improved face shield is provided. In one non-limiting example, a face shield is disclosed that is configured to interface with and be supported by a brim of a hat. In some implementations, the face shield may include a substantially transparent sheet of material and a slot provided in the substantially transparent sheet of material. The substantially transparent sheet of material may be supported by the brim of the hat when the brim is inserted through the slot.

In some examples, the face shield may include a snap-on strip that is releasable connectable to the transparent sheet of material. The snap-on strip may reinforce the substantially transparent sheet of material and impart a shape to the substantially transparent sheet of material when connected to the substantially transparent sheet of material. The snap-on strip may include one or more attachment mechanisms. The one or more attachment mechanisms may include at least two clasps, where each clasp comprises a hinge and a pivotable component, where the hinge is connected to the pivotable component, where the pivotable component is configured to wrap around the substantially transparent sheet of material, and where the at least two clasps provide a locking mechanism such that the snap-on strip attaches to the substantially transparent sheet of material when the pivotable component wraps around the substantially transparent sheet of material.

DETAILED DESCRIPTION

Embodiments of the present disclosure will be described in connection with a face shield. Before any embodiments of the disclosure are explained in detail, it is to be understood that the disclosure is not limited in its application to the details of construction and the arrangement of components set forth in the following description or illustrated in the following flowcharts. The disclosure is capable of other embodiments and of being practice or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
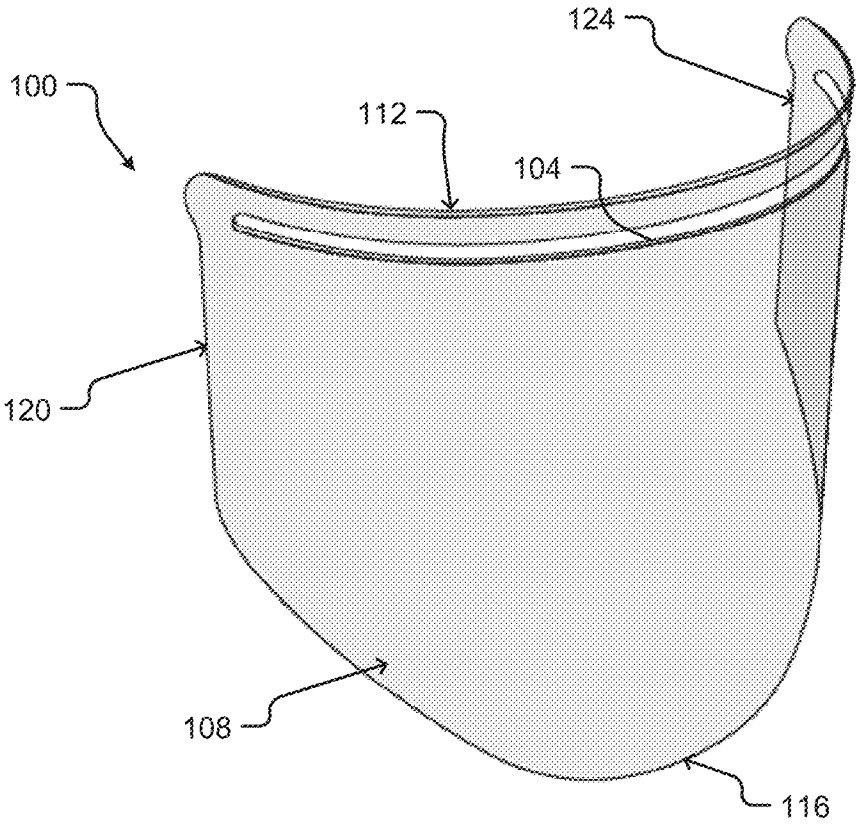
FIG. 1 shows a face shield in accordance with embodiments of the present disclosure.

FIG. 1 illustrates a face shield 100 in accordance with embodiments of the present disclosure. The face shield 100 may comprise a top end 112, a bottom end 116, and two sides 120, 124 that extend between the top end 112 and the bottom end 116. The face shield 100 may contain a slot 104 provided in a substantially transparent material 108, which is shown to include a curved surface. While FIG. 1 illustrates the transparent material 108 as being curved, it should be appreciated that the transparent material 108 may be substantially planar in a non-worn state, but may then flex into a curved shape when placed onto a brim of a hat. In other words, the transparent material 108 may be flexible and transition between a flat sheet of material when not worn and a curved sheet of material when worn. In other embodiments, the transparent material 108 may be substantially pre-bent and more rigid such that the transparent material 108 does not substantially flex or change shape when placed on the brim of a hat.

The slot 104 may permit a user to attach the face shield 100 to any horizontal entity. For instance, the user may wish to attach the face shield 100 to a hat. In this case, the user may be allowed to slide the brim of the hat through the slot 104 to mount the face shield 100 onto the hat. The slot 104 may be designed to allow the user to adjust the distance between the user's face and the face shield 100 without compromising the stability of the mounting of the face shield 100. The face shield 100 may be substantially transparent, so as to allow the user to view the environment surrounding the user, and for others in the area to view the user. In some embodiments, the slot 104 may be located substantially close to the top end 112 of the face shield 100, and may extend almost entirely between the two sides of the face shield 100. In some embodiments, the two sides may be linear or non-linear. In other words, the two sides may be parallel to one another or may have one or more curved features that protect a side of a user's face when the slot 104 receives a brim of a hat. As shown in FIG. 1, the transparent material 104 may be wider near the top end 112 and narrower near the bottom end 116 thereby providing more protection around the sides of a user's eyes.

The slot 104 may be designed to fit specifically to the hat. For example, the slot 104 may be designed to mount to a specific hat. In one embodiment, the slot 104 may be designed to specifically mount to a baseball cap. It is to be understood that the term "hat" may refer to any head-mounting apparatus or shaped covering for the head. For instance, a hat may be, but is in no way limited to, a baseball cap, a helmet, a visor, or any other head covering containing a horizontally extruding edge to which the face shield 100 may attach.

In some embodiments, the slot 104 may be designed to be adaptable, and may fit to a variety of hats. For instance, the slot 104 may be constructed from a flexible material capable of forming to the hat during the mounting process. In this example, the slot 104 may be change shape to accommodate the brim of the hat, and may form to the brim of the hat to secure the face shield 100 to at least a portion of the brim and/or hat. In some embodiments, the slot 104 may be adaptable, and may be capable of conforming to the brim of more than one hat. For instance, the slot 104 may conform to a first hat and, upon removal and mounting to a second hat, may conform again to fit the second hat. In one embodiment, the face shield 100 may begin as a flat sheet and, as the user mounts the face shield 100 to the hat, the face shield 100 may bend to take the shape of the brim of the hat. In some embodiments, the dimensions of the slot 104 (e.g. width, length, height) may be adjusted based specifications of the brim of the hat. The adjustment of the dimensions of the slot 104 is not particularly limited, and the adjustment may occur during the manufacturing of the face shield 100, after the manufacturing of the face shield 100, or a combination thereof. The conformation to the brim of the hat may cause the formation of the curved surface.

The slot 104 may provide flexible structures capable of holding the transparent material 108 in place. For instance, the flexible structures may be a plurality of teeth that contact the brim of the hat to prevent the face shield 100 from sliding off the hat. Additionally or alternatively, the slot may comprise a seal to help prevent hazards from external sources from passing through the face shield 100 to the user. Moreover, the seal may prevent any pathogens associated with the user from passing through the face shield 100 to the surrounding environment. The seal may extend along the perimeter of the slot 104, and may create a vacuum seal to eliminate the flow of potentially harmful materials between the external environment and the user.

The transparent material 108 may be designed to protect the user and/or others around them. The transparent material 108 may be constructed with any number of materials. Non-limiting examples of such materials include plastic, glass, acrylic glass, transparent ceramics, etc. Any material or combinations of materials, as long as such materials are at least partially translucent, may be used to construct the transparent material 108.

The transparent material 108 may contain one or more coatings of other materials to further enhance the optical performance thereof. The one or more coatings may be applied to the transparent material 108 in a number of ways; some examples of methods that may be used to apply the one or more coatings to the transparent material 108 include, but are in no way limited to: liquid deposition, vacuum deposition, chemical vapor deposition, chemical deposition, dip coating methods, various lamination techniques, RF or DC sputtering, electron beam evaporation, combinations thereof, and/or the like. This list is in no way exhaustive; any other method of physical and/or chemical deposition may be implemented, so long as the transparent material 108 is coated in the one or more coatings.

The one or more coatings may be applied to the transparent material 108 in any combination and may additionally or alternatively coat one or more sides of the transparent material 108. In some embodiments, the one or more coatings may be partially applied to the transparent material 108, such that only a portion of the transparent material 108 receives the one or more coatings. The number of coatings and the order in which the coatings may be applied is in no way limited, and any number of coatings may be applied to the transparent material 108.

In some embodiments, the transparent material 108 may include an ultraviolet (UV) light protection coating. The UV protection coating may filter UV light to help protect the user's eyes. The UV protection coating may contain additional or alternative coatings for different wavelengths of light to help protect the user's eyes. The UV protection coating may additionally or alternatively protect the user from other hazardous energy sources that may damage the user's eyes.

The transparent material 108 may contain a coating that improves light transmission and visibility. For instance, the coating may allow light to better pass through the shield, allowing the user to better see the environment through the face shield. The increased light transmission may be either unidirectional or bidirectional; the light transmitted may be increased in only one direction, or in both directions as light passes through the face shield 100.

The transparent material 108 may comprise a chemical resilient coating. The chemical resilient coating may improve resistance to chemical change in the face shield 100. For example, the chemical resilient coating may be resistant to changes in pH, and thus may prevent the face shield from being damaged by acidic or basic components. In some embodiments, the chemical resilient coating may provide chemical protection to the other coatings on the transparent material 108, to prevent damage to the other coatings.

The transparent material 108 may provide prescription level visual improvement, and may contain a prescription to the user's eyes. For example, the user may utilize prescription lenses, and may desire to not wear the prescription lenses while using the face shield 100. In this case, the transparent material 108 may be designed to function as a substitute for the prescription lenses by providing the same level of light bending to the user's eyes as the prescription lenses. In some embodiments, the transparent material 108 may be manufactured uniquely for the user by incorporating the user's eyewear prescription into the face shield 100. This way, the user may retain the same level of vision with the face shield 100 as with the prescription lenses, and may not need to wear the prescription lenses while using the face shield 100.

The transparent material 108 may have a protection coating. The protection coating may be designed to mitigate damage to the face shield 100. For instance, the protection coating may contain a scratch-resistant material to reduce the probability of the transparent material 108 being scratched, cracking, breaking, or otherwise being damaged. In some embodiments, the protection coating may provide a fireproof layer of protection to help mitigate the risk of fire damage. The protection lay may be resilient to high heat, and may be display resistance to melting in high-heat environments, such as welding. In this example, the heat capacity of the transparent material 108 may be substantially increased by the addition of the protection coating, allowing the face shield 100 to be used in heat-intense environments without risk of the transparent material 108 melting or being damaged.

The transparent material 108 may contain an anti-microbial coating. The anti-microbial coating may be designed to capture and kill any pathogens contacting the face shield 100. The anti-microbial coating may comprise a general anti-microbial solution designed to kill a broad spectrum of microbes. In some embodiments, the anti-microbial coating may be specialized to kill a specific type of pathogen or biological hazard, such as bacteria. The anti-microbial coating is not limited to killing specific types of pathogens, and may be designed to kill or neutralize other hazardous biological threats. Some types of microorganisms and biologically hazardous materials that the anti-microbial coating may be capable of killing or neutralizing may be, but is in no way limited to, bacteria, fungi, viruses, yeasts, molds, parasites, and toxins.

The transparent material 108 may have an anti-fog coating. The anti-fog coating may reduce the amount of condensation on the face shield 100. In some embodiments, the anti-fog coating may be applied to the surface of the transparent material 108 facing the user so as to limit condensation caused by the user's breath. Additionally or alternatively, the anti-fog coating may be applied to the surface of the face shield 100 facing away from the user and/or both surfaces of the face shield 100 to limit the amount of condensation on the face shield 100. Additionally or alternatively, the anti-fog coating may quickly clear condensation from one or both surfaces of the face shield 100, allowing the user to maintain clear vision through the face shield 100.

In some embodiments, at least one coating of the one or more coatings may comprise an electrically conductive material. The electrically conductive material may be a chemical compound and/or chemical mixture or may be any other type of naturally and/or artificially conductive material capable of permitting the at least one coating to be electrically conductive.

The electrically conductive material may provide one or more electrical functions. For instance, the electrically conductive material may function as a semiconductor, and may generate regions within the at least one coating that are electrically biased to current. Additionally or alternatively, the electrically conductive material may comprise a photodetector and a photoreceptor. The photodetector and photoreceptor may both be sensitive to light, and may be coupled electrically with the portion of the electrically conductive material that functions as a semiconductor, allowing the at least one coating to generate solar energy.

Additionally or alternatively, the electrically conductive material may comprise a thermally sensitive component. The thermally sensitive component may detect the temperature of the surroundings of the transparent material 108. The surroundings may additionally or alternatively include the wearer of the face shield 100; in other words, the thermally sensitive component may detect the temperature of the wearer of the face shield 100. In one embodiment, the thermally sensitive component may provide feedback to the user or wearer of the face shield 100. For example, the thermally sensitive component may comprise a mixture whose color changes with a change in temperature. The mixture may, in the case that the user has a high temperature (e.g., the user has a fever), change color, which may provide a visual indicium to the user that the user may be sick. In some embodiments, the thermally sensitive component may be coupled to one or more feedback mechanisms and/or electrical components capable of providing feedback to the user. For instance, the feedback mechanism may be an audio device (e.g., a speaker) coupled to the thermally sensitive component. When the thermally sensitive component detects the high temperature of the user, the audio device may receive this information and issue an audio indicium to the user to alert the user as to the high temperature.

The electrically conductive material may act as a gas sensor to indicate that one or more hazardous conditions and/or gases are present. For instance, the electrically conductive material may comprise materials that are sensitive to and/or chemically react with hazardous materials and/or gases. The electrically conductive material may then, in the event that the electrically conductive material is exposed to a hazardous material and/or a hazardous gas, chemically react and provide an indicium to the wearer of the face shield 100 of the hazardous material. In one embodiment, the electrically conductive material may change color when interacting with one or more hazardous materials. In this case, the presence of the one or more hazardous materials may cause the electrically conductive material to change color, which may provide the wearer with a visual indicium that the one or more hazardous materials is present. In some embodiments, the face shield 100 may be treated with or covered by a photochromic or chemochromic material that enables the face shield 100 (and specifically the transparent material 108 thereof) to change colors or tint based on lighting conditions (e.g., incident photons) and/or chemical conditions (e.g., presence of or lack of presence of certain chemicals). In this way, the transparent material 108 may transition between different colors, shades, tints, etc. based on environmental conditions surrounding the face shield 100.

The electrically conductive material may provide either passive and/or active acoustic detection and/or a heads-up display (HUD). For instance, the electrically conductive material may comprise one or more sensors and a visual display that provides information to the wearer of the face shield 100. The visual display may provide data collected from the one or more sensors to the wearer without requiring the wearer adjust their viewpoint.

The coating application may occur on at least a portion of the face shield 100. Additionally or alternatively, the coatings may be applied in any order. The coatings previously mentioned are not limited, and additional or alternative coatings may be implemented.

The face shield 100 may comprise a hinge to permit the user to quickly rotate the shield without the need to remove the head covering. The hinge may be located between the bottom end 116 and the top end 112 and allow the top end 112 to remain connected with the brim of the hat while the bottom end 116 folds upwards towards the brim of the hat. The hinge may include a biasing mechanism to maintain the upward fold. The biasing mechanism may be biased in both the forward and reverse directions (i.e. upon the bottom end 116 folding toward the top end 112, the biasing mechanism may prevent the bottom end 116 from folding downward without sufficient force from the wearer; similarly, the bottom end 116 may not fold upward toward the top end 112 without sufficient force from the user to prevent unwanted upward folds).

In some embodiments, the face shield 100 may comprise a connector. The connector may be positioned on either the top end 112 or the bottom end 116 of the face shield 100, and may allow the top end 112 and the bottom end 116 to attach to one another when the connector is in the non-worn state.

In some embodiments, the hinge and the connector may be molded into the face shield 100.

Figure 2:
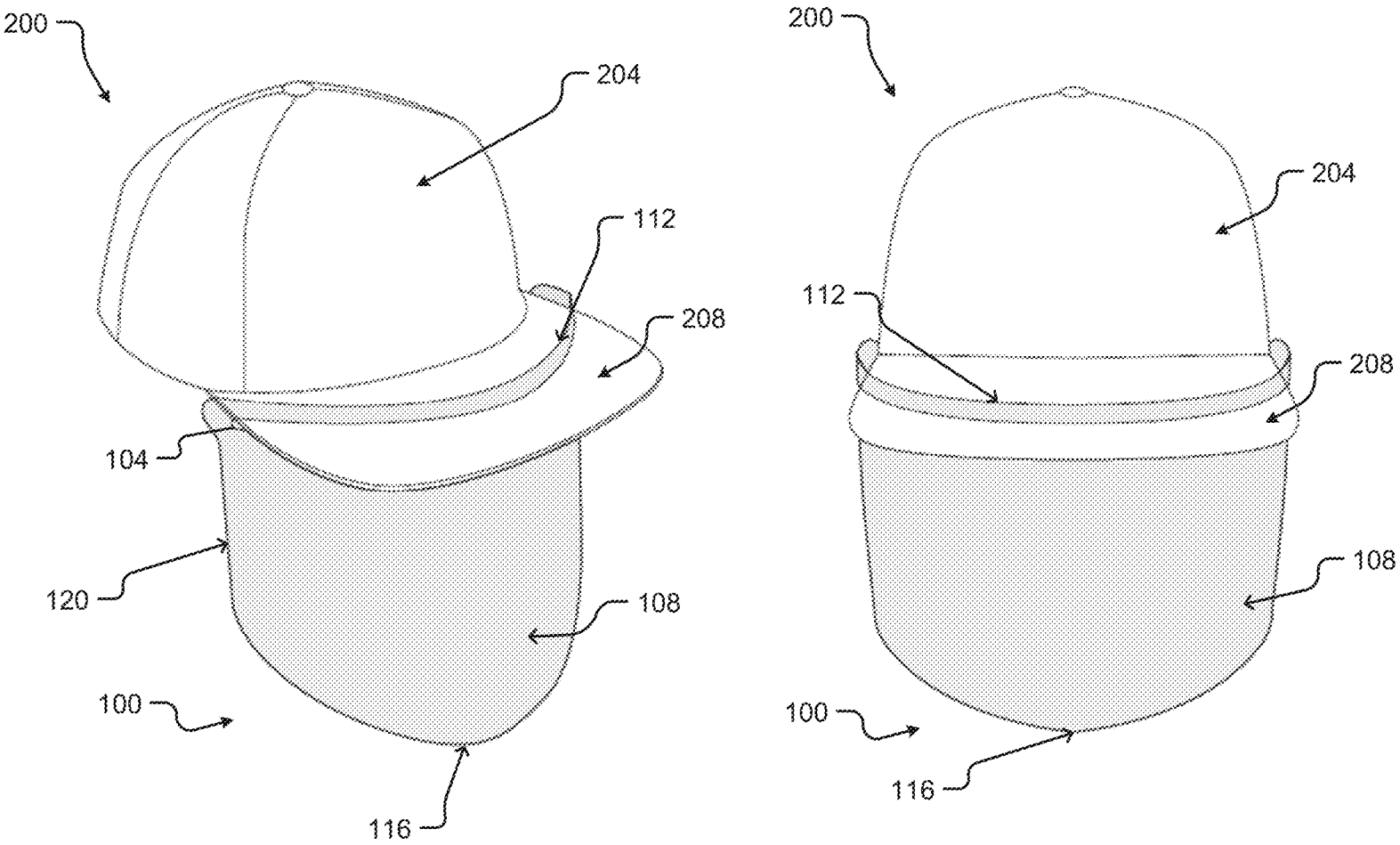
FIG. 2 shows the face shield mounted to a head-mounted apparatus in accordance with embodiments of the present disclosure.

FIG. 2 shows a system 200 in which the face shield 100 may be used in accordance with embodiments of the present disclosure. The system 200 may comprise the face shield 100 and a head-mounted apparatus 204. The head-mounted apparatus 204 may rest, attach to, or otherwise contact the head of a user/wearer. In one embodiment, the head-mounted apparatus may be a hat as depicted. The head-mounted apparatus 204 may comprise a brim 208. The brim 208 may extend from the head-mounted apparatus. In one embodiment, the brim 208 may extend from a cap, which may provide shade to the user of the cap. As previously noted, the slot 104 may be designed to accept and conform to the brim 208 of the head-mounted apparatus 204 to slide through the slot 104, resulting in the face shield 100 attaching to the head-mounted apparatus 204.

Figure 3:
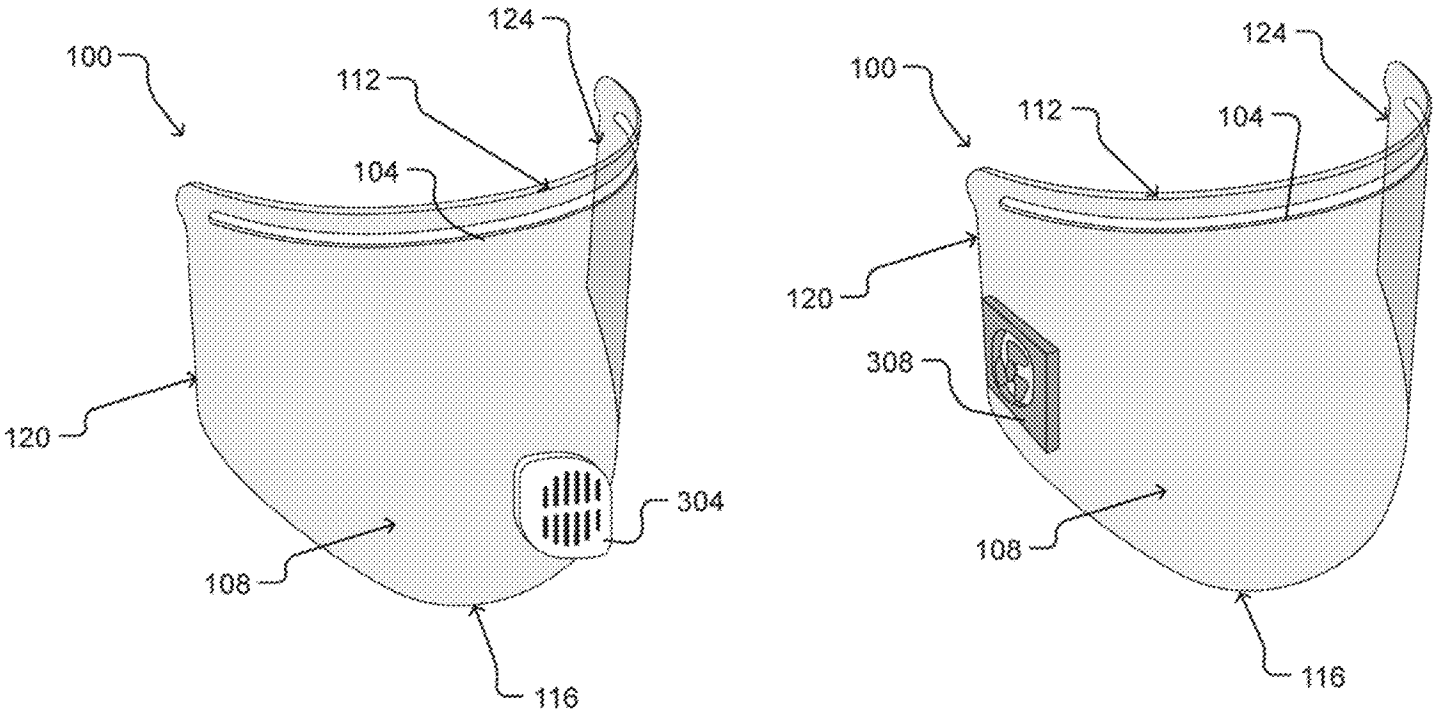
FIG. 3 shows additional or alternative face shield features in accordance with embodiments of the present disclosure.

FIG. 3 presents various additional or alternative features of the face shield 100. For instance, the face shield 100 may possess a portal 304. The portal 304 may permit the user to better communicate through the face shield 100 to others in the area of the user. The portal 304 is not particularly limiting, and various technical formulations may be implemented. The portal 304 may be electro-mechanical or mechanical in nature, and may amplify, alter, filter, or otherwise permit the user's voice to pass from the user through the face shield 100 to others in the area without degradation of either sound amplitude and/or clarity. In one embodiment, the portal 304 may comprise a microphone on the side of the transparent material 108 facing the wearer, whereas a speaker may be provided on the opposing side of the transparent material 108 to face a non-wearer of the face shield 100. The microphone may receive the user's voice as input, and the output of the microphone may be electrically provided to the speaker, thereby allowing the speaker to project the wearer's voice so that others in the area may more clearly understand what the wearer is saying.

The face shield 100 may possess a ventilation mechanism 308. The ventilation mechanism 308 may provide ventilation to the user. The ventilation mechanism 308 may be, but is in no way limited to, a fan. In some embodiments, the ventilation mechanism 308 may comprise a sensor capable of determining the carbon dioxide concentration near the face shield 100, and may activate in order to properly ventilate the face shield 100 upon detection that the carbon dioxide concentration rises above a certain concentration. In some embodiments, the ventilation mechanism 308 may occur passively. In one embodiment, the ventilation mechanism 308 may contain a filter capable of filtering the vented air. For instance, if the user is sick, the ventilation mechanism 308 may implement a filter for any air leaving the area around the user's face to capture and prevent the release of any pathogens and/or biologically hazardous vapors that may be present in the vented air. In some embodiments, the ventilation mechanism 308 may correspond to one or more simple vents/slots/holes in the transparent material 108. The position of such vents/slots/holes may be provided directly in front of the wearer's face (e.g., in a similar position to the portal 304) or may be provided on a side of the wearer's face (e.g., in a similar position to the ventilation mechanism 308). In some embodiments, the vents/slots/holes may be provided near the top of the transparent material 108 (e.g., near the slot 104). The transparent material 108 may include one or multiple vents/slots/holes, if desired.

Figure 4:
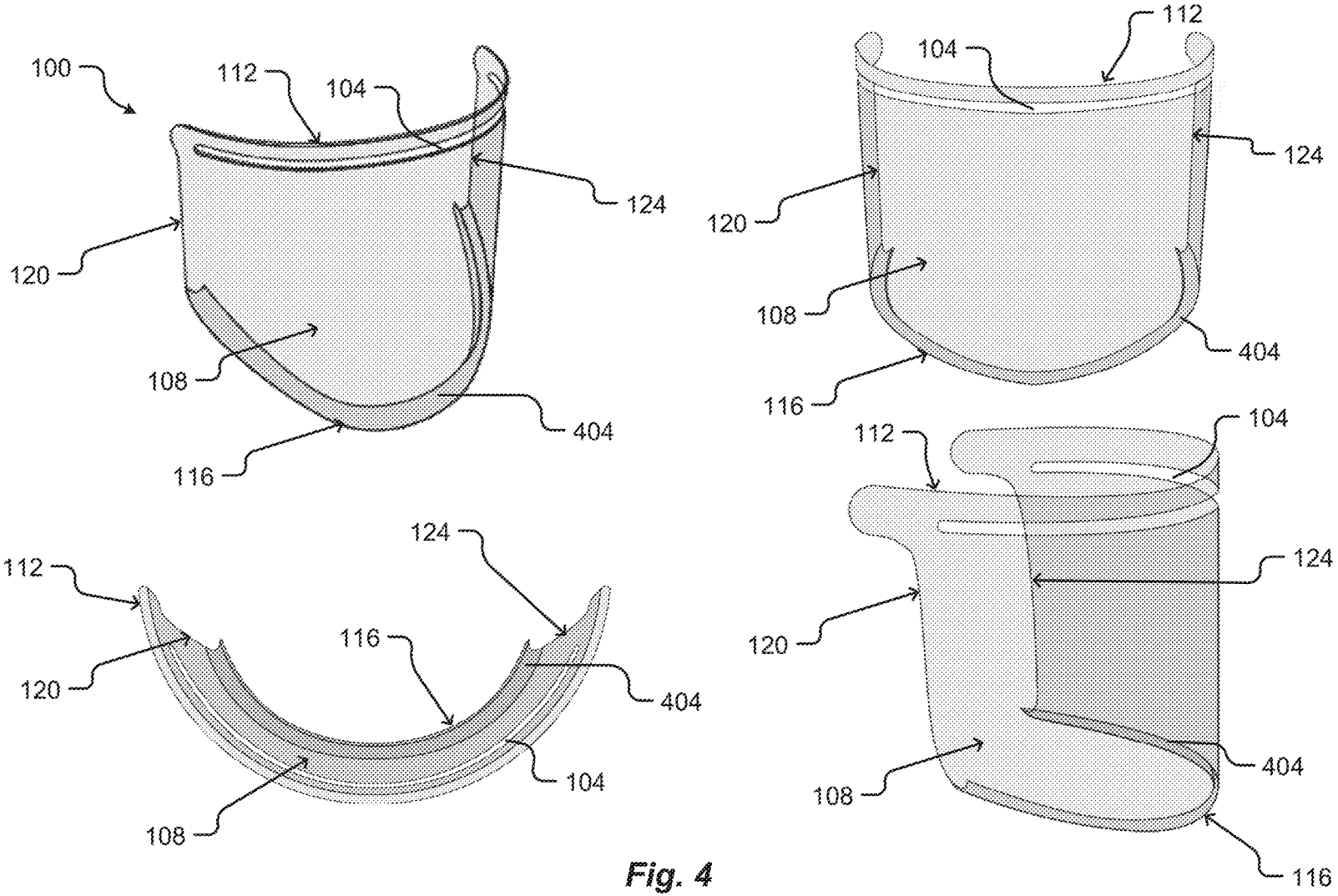
FIG. 4 shows additional or alternative face shield features in accordance with embodiments of the present disclosure.

As depicted in FIG. 4, the transparent material 108 of the face shield 100 may include a lip 404. The lip 404 may be designed to enhance the protective features of the face shield 100. The lip 404 may provide a reservoir designed to entrap droplets expelled by the user. For example, the lip 404 may catch any saliva exiting from the user's mouth when the user is speaking. In some embodiments, the lip 404 may be curved, curled, or otherwise angled toward the user, as denoted in FIG. 4, to better capture any expulsions from the user. The lip 404 may capture additional or alternative forms of expulsions (e.g. body fluids and/or solids associated with coughs, sneezes, perspiration, runny noses, and/or combinations thereof), and are in no way limiting to what is listed herein. In one embodiment, the lip 404 may extend from the bottom end 116, as depicted.

The face shield 100 may additionally or alternatively comprise an absorbent material. The absorbent material (not shown) may function to absorb any droplets expelled by the user. For example, the absorbent material may capture any forms of expulsions (e.g., body fluids associated with coughing, sneezing, breathing, speaking, and/or combinations thereof) from the user. The types of material captured by the absorbent material and the source of the material is not limited, and various expulsions from, by way of example only, the user's mouth, eyes, ears, nose, and/or combinations thereof may be captured. For example, the absorbent material may be designed to capture any perspiration associated with the user. Additionally or alternatively, the absorbent material may provide anti-microbial properties. For instance, the absorbent material may contain chemical compounds and/or mixtures designed to actively or passively inhibit any pathogenic material that comes into contact with the absorbent material. The type of pathogenic material is in no way limited, and the absorbent material may be capable of biologically disabling and/or neutralizing any type of microbe mentioned in the present disclosure.

In some embodiments, the absorbent material may be temporarily or permanently adhered to one or more components of the face shield 100. In one embodiment, the absorbent material may be affixed on an inside surface (e.g., second surface) of the transparent material 108 and may be positioned below the eyes of the wearer. The absorbent material may then capture any droplets expelled by the user and render them biologically harmless.

Figure 5A:
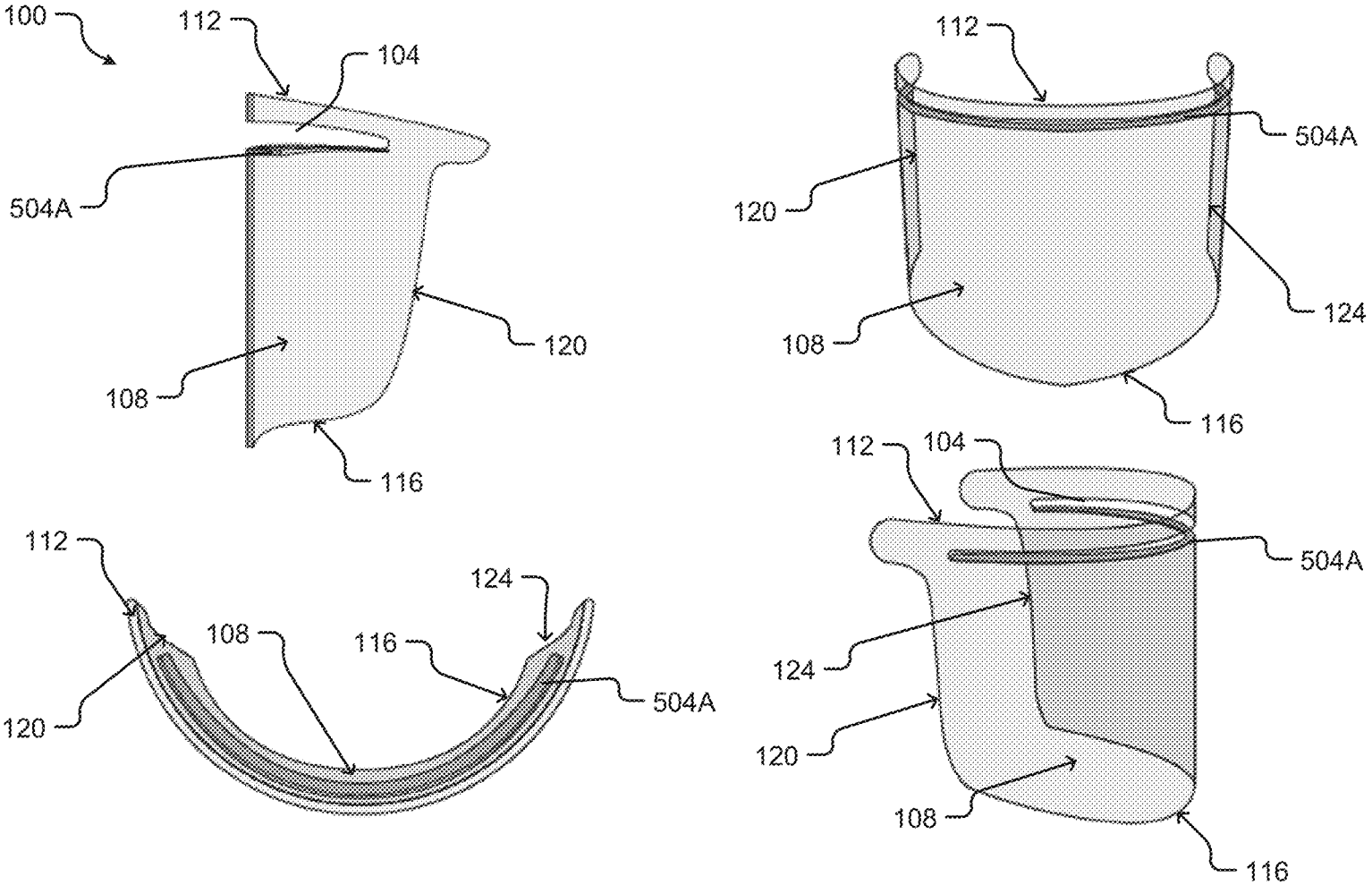
FIGS. 5A-5D show a variety of benches of the face shield in accordance with embodiments of the present disclosure.
Figure 5B:
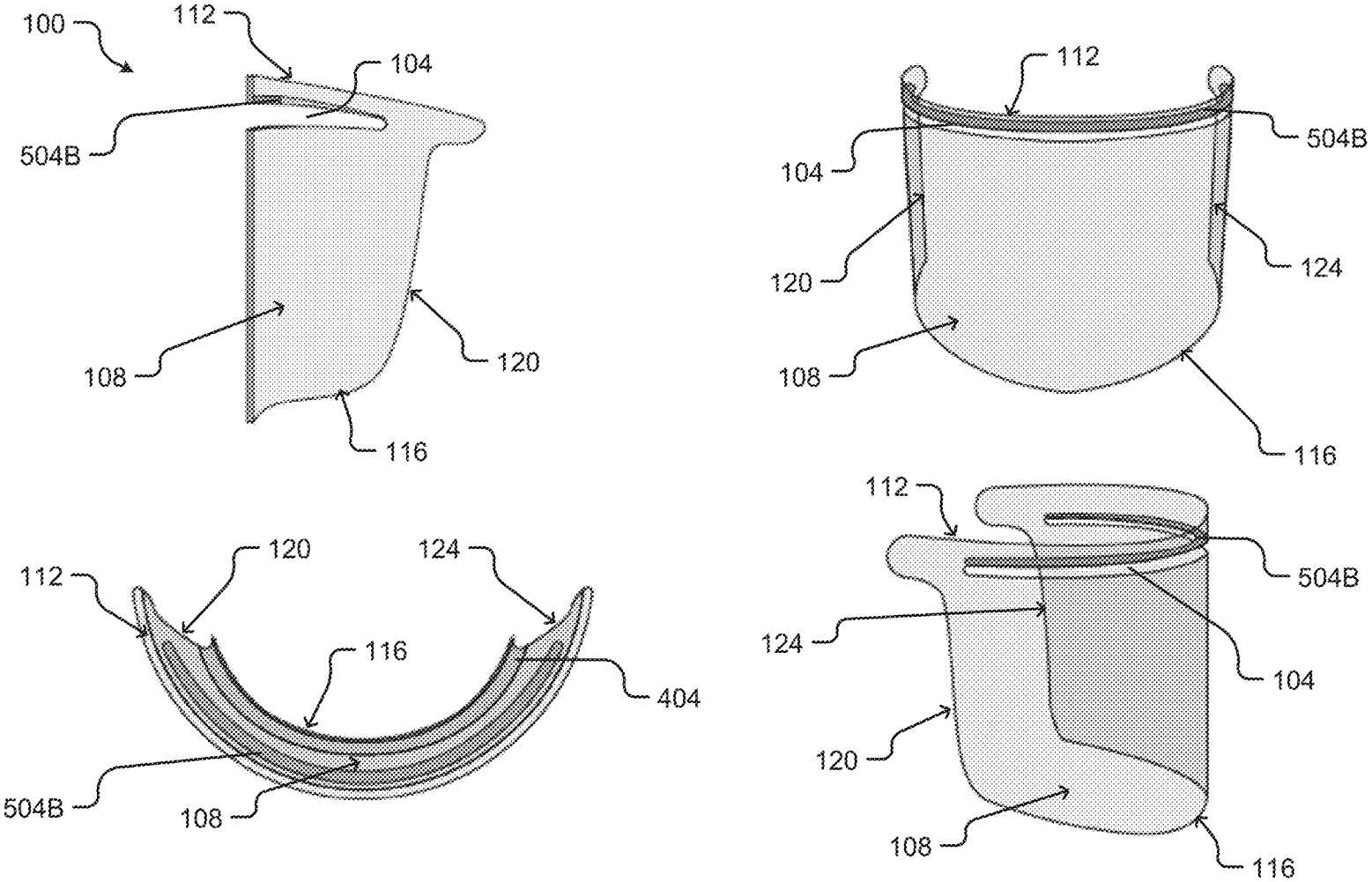
Figure 5C:
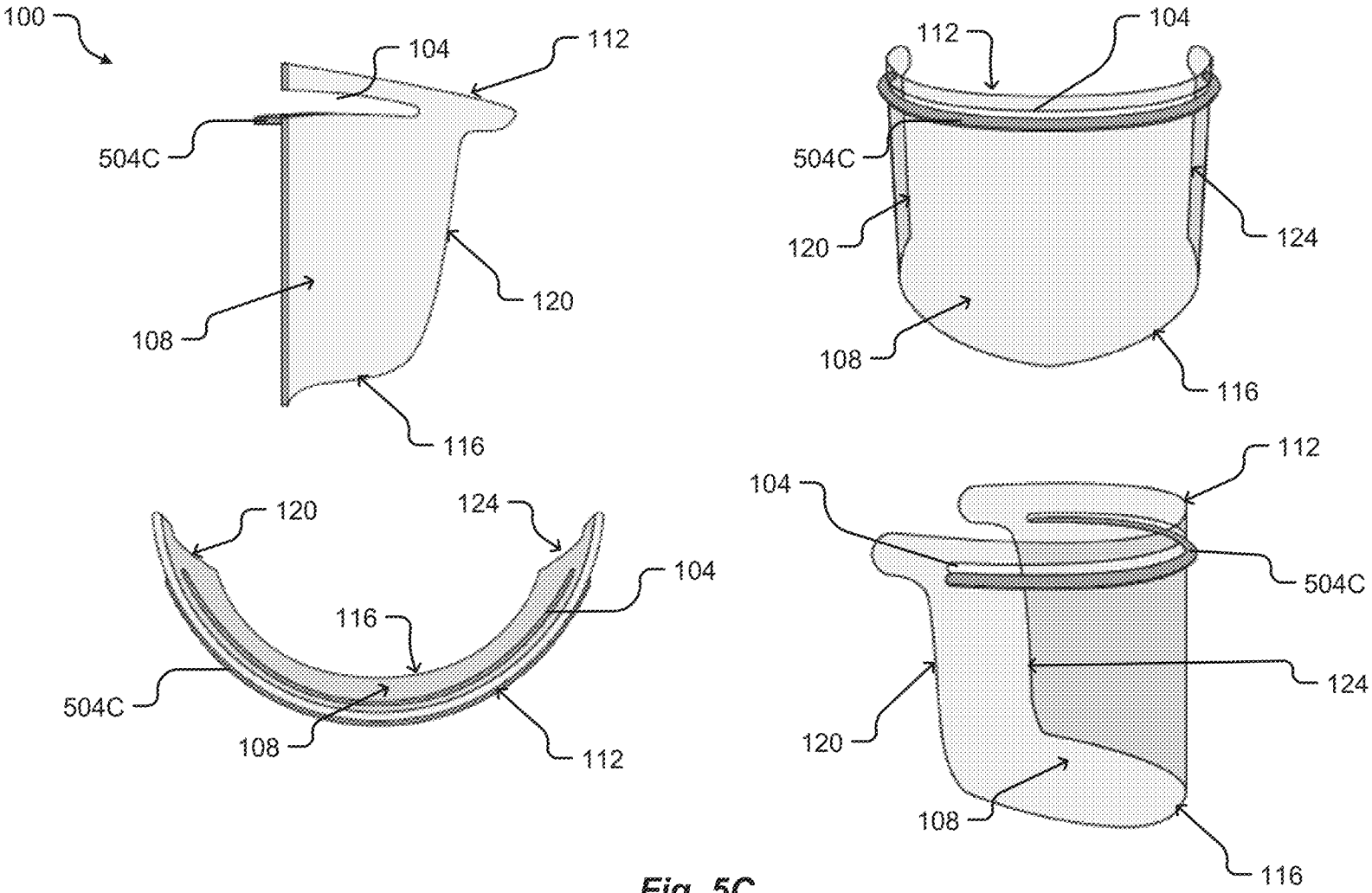
Figure 5D:
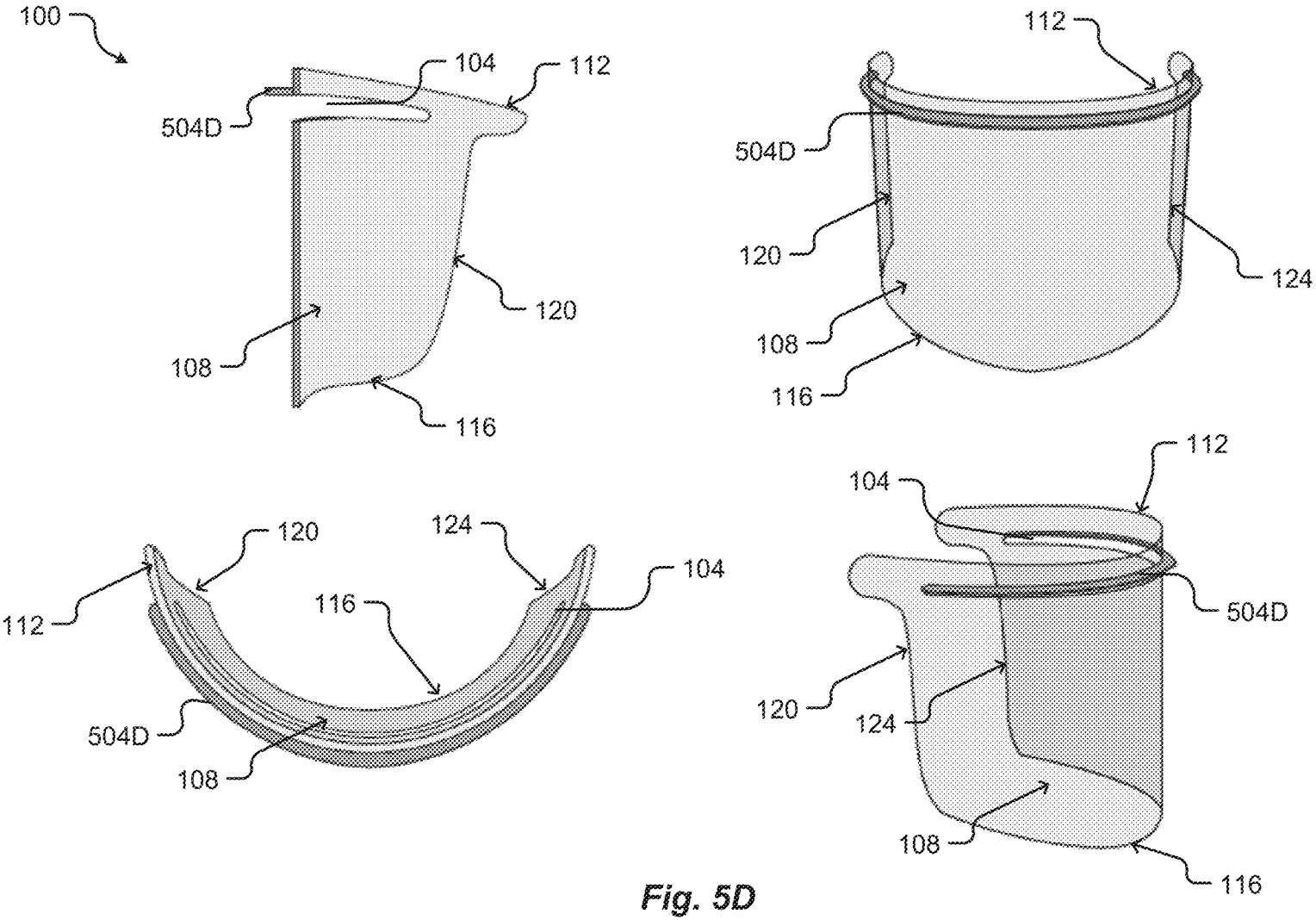

The slot 104 may provide a bench, as indicated by FIGS. 5A-5D. The bench may be formed from the material that would otherwise be removed during the formation of the slot 104. Instead of removing the material, one edge of the material may remain attached to the face shield 100. As indicated by FIG. 5A, a bench 504A may remain attached to a bottom end of the slot 104, and may be folded toward the surface of the face shield 100 that faces the user. Accordingly, during the mounting of the face shield 100 to the hat, the bench 504A may contact the bottom surface of the brim of the hat. The bench 504A may provide stability to the face shield 100, and may keep the face shield 100 parallel to the user's face during use. The edge of the bench that remains attached to the face shield 100 as well as the direction in which the bench folds are not particularly limited. For instance, a bench 504B may remain attached to a top end of the slot 104, and may fold inward toward the face of the user, such that the bench 504B contacts the top of the brim of the hat. A bench 504C may remain attached to the bottom end of the slot 104, but may fold outward away from the face of the user, so as to contact the bottom of the brim of the hat. A bench 504D may remain attached to the top end of the slot 104, but may fold outward away from the face of the user and contact the top of the brim of the hat.

The benches 504A-504D may comprise a bendable material so as to conform to the contours of the brim of the hat.

As previously noted, the slot 104 may be pre-formed to fit a specific hat, or may be flexible and adaptable to fit any brim of any hat. Similarly, the benches 504A-504D may be complementarily formed so as to fit either a specific hat or any brim of any hat.

Figure 5E:
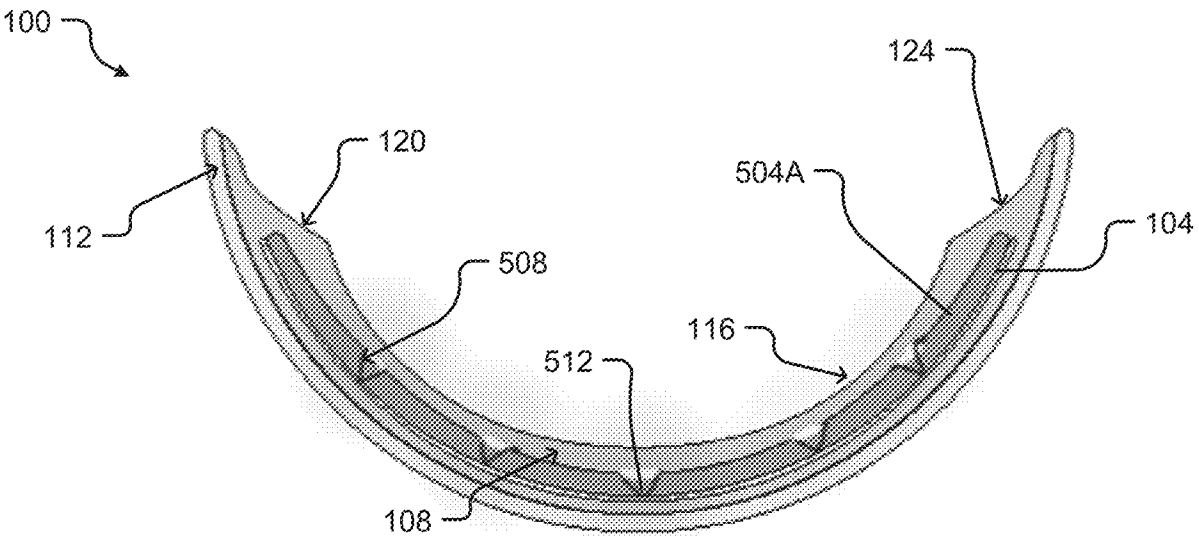
FIG. 5E shows a relief cuts of the variety of benches in accordance with embodiments of the present disclosure.

As depicted in FIG. 5E, any configuration of the benches 504A-504D may contain relief cuts 508 to permit the face shield 100 to conform to the shape of the brim of the hat. The relief cuts 508 remove intra-material tension from the benches 504A-504D as the face shield 100 forms the curved surface 108. As noted in FIG. 5E, the bench 504A may contain a plurality of notches 512 that create sections of the bench 504A. The relief cuts 508 allow the face shield 100 to more easily bend to fit the form of the brim of the hat, which gives the user an improved experience in using the face shield 100. In some embodiments, the plurality of notches 512 are removed in accordance with a specific hat such that the face shield 100 conforms to the brim of the specific hat.

Figure 6:
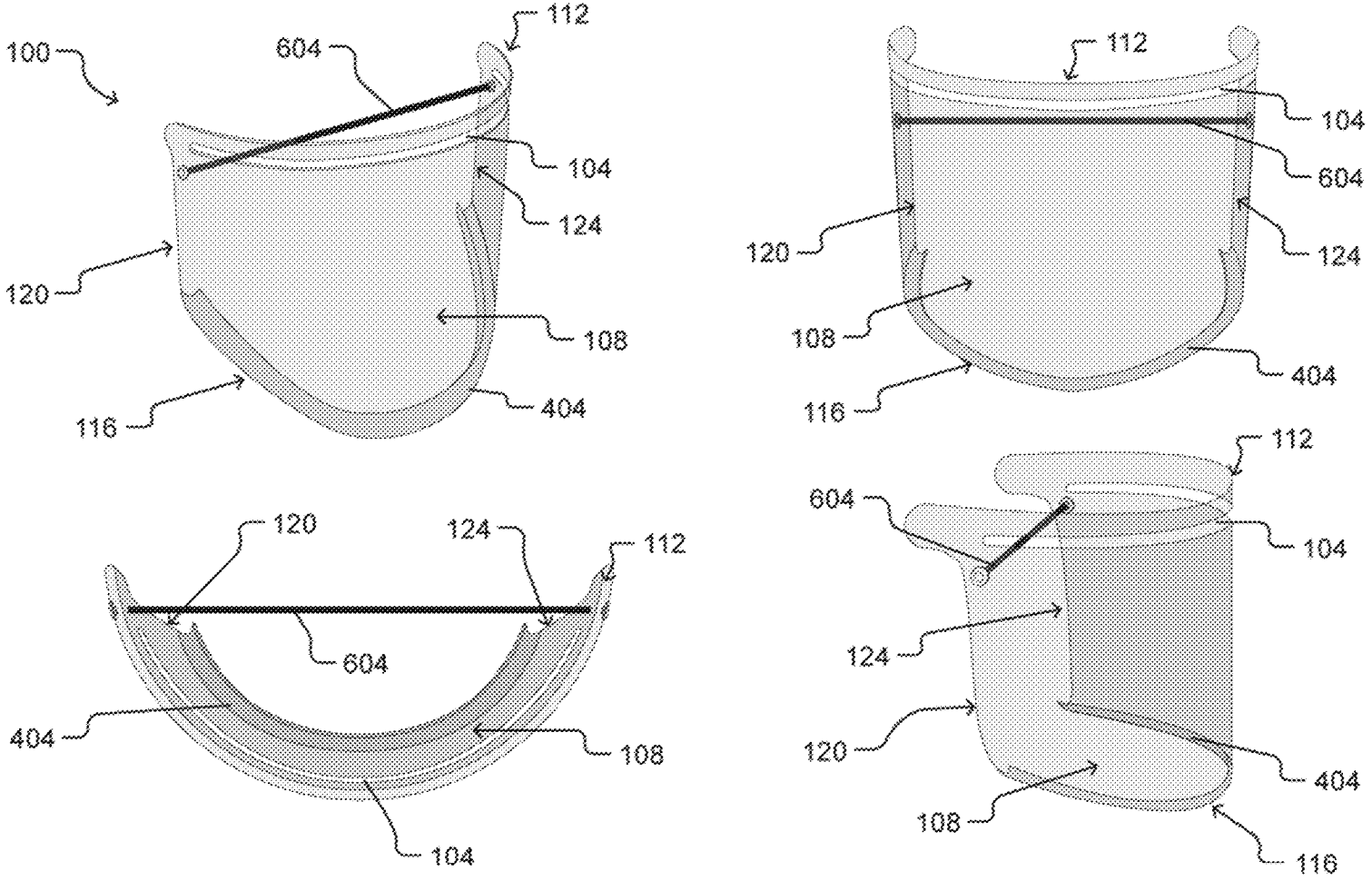
FIG. 6 shows a strap for the face shield in accordance with embodiments of the present disclosure.

FIG. 6 depicts a strap 604 that may be attached to the face shield 100. The strap 604 may be attached below the slot 104 and may automatically transition the face shield 100 from the non-worn state to the flexed state. The strap 604 may connect to the two sides 120, 124 such that the strap 604 pulls the two sides 120, 124 closer together, creating the curve in the transparent material 108. In some embodiments, the strap 604 may be flexible and/or elastic and may stretch as the two sides 120, 124 move further apart. The strap 604 may additionally or alternatively be rigid in nature and may resist changes in distance between the two sides 120, 124. In some embodiments, the strap 604 may keep the two sides 120, 124 at a constant distant from one another.

In some embodiments, the strap 604 may be permanent. In other words, the strap 604 may be designed and/or manufactured with the intent that the user/wearer be unable to remove the strap 604 from the face shield 100. The strap 604 may alternatively be designed to be removable. That is, the strap 604 may comprise one or more disconnectors that may disconnect the strap 604 from the face shield 100.

The strap 604 may be constructed with any number of materials. Non-limiting examples of such materials include natural rubbers (e.g. latex), synthetic rubbers (e.g. butadiene, isoprene, fluorocarbon, nitrile, silicone, urethane, chloroprene), and/or combinations thereof. Any material or combination of materials providing some level of flexibility to the strap 604 may be used. These materials may give the strap 604 the desired flexibility. Alternatively, the strap 604 may be made of a material designed to give the strap 604 rigidness. One non-limiting example of such a material may be leather. Any material or combination of materials providing rigidness to the strap 604 may be implemented.

Figure 7:
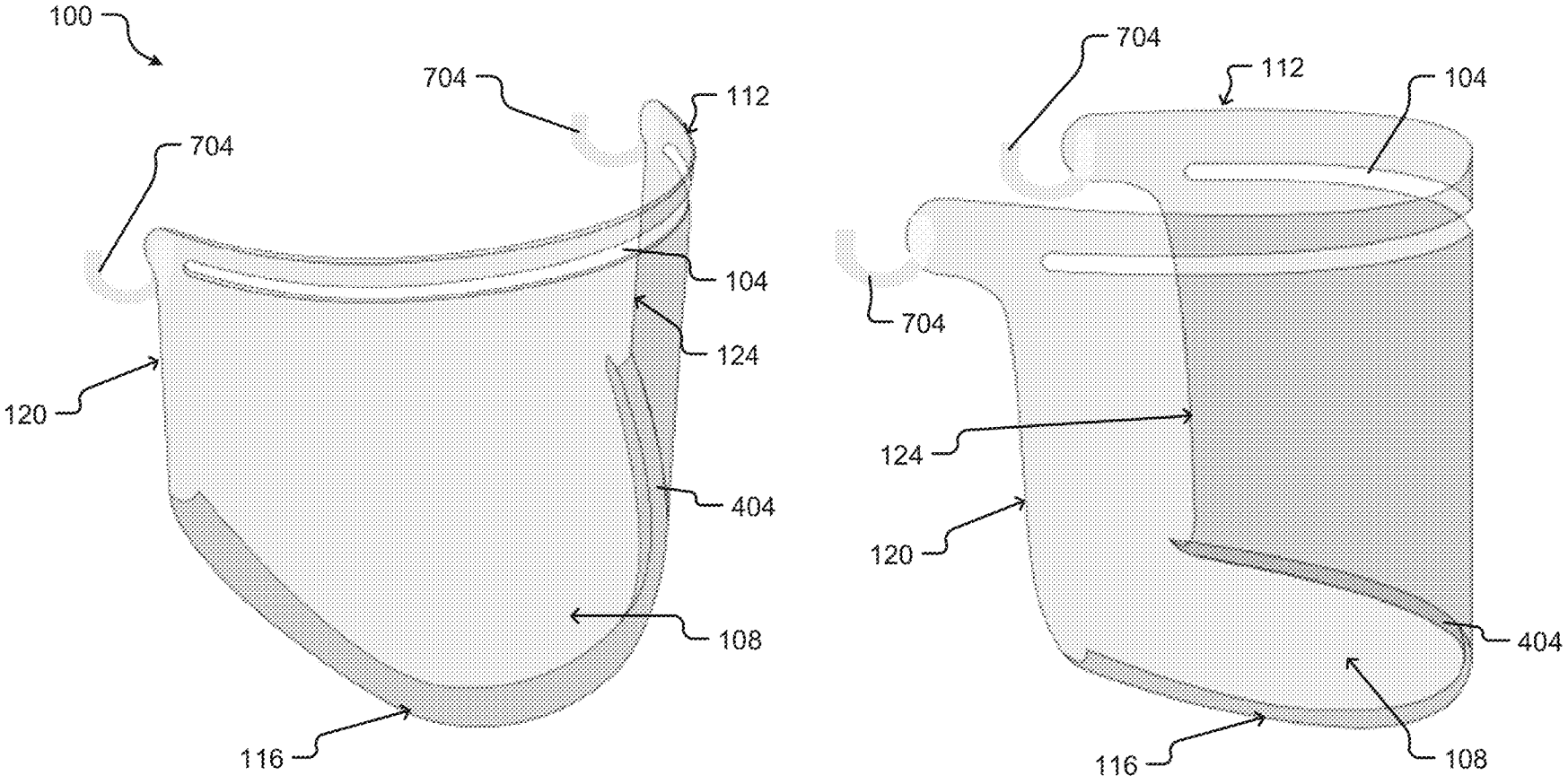
FIG. 7 shows hooks for the face shield in accordance with embodiments of the present disclosure.

FIG. 7 shows hooks 704 attached to the face shield 100. The hooks 704 may attach to the two sides 120, 124 and may allow the wearer to hook the face shield 100 around their face when the face shield 100 is mounted to the brim of the hat. It should be appreciated that the hooks 704 may be integrated with the transparent material 108. As a non-limiting example, the hooks 704 may be fixed to or over molded into the transparent material 108. It should also be appreciated that the hooks 704 may be releasably attached (e.g., by way of snap fitting, buttons, magnets, etc.) to the transparent material 108. In some embodiments, the wearer may bring the hooks 704 together around the back of the wearer's head and connect the hooks 704 together. Alternatively or additionally, the hooks 704 may be configured to slip and hang onto a bottom edge of the wearer's hat. As another alternative, the hooks 704 may be configured to wrap around the wearer's ears or side of the wearer's head. Connecting the hooks 704 together may provide additional stability to the face shield 100 and may provide the wearer greater protection while using the face shield 100. In some embodiments, the hooks 704 may be die cut and affixed to the face shield 100. In one embodiment, the hooks 704 may be molded into the face shield 100. The location of the hooks 704 is not particularly limited, and any configuration of the hooks 704 that permits the wearer to hook the face shield 100 around their face may be implemented.

Figure 8:
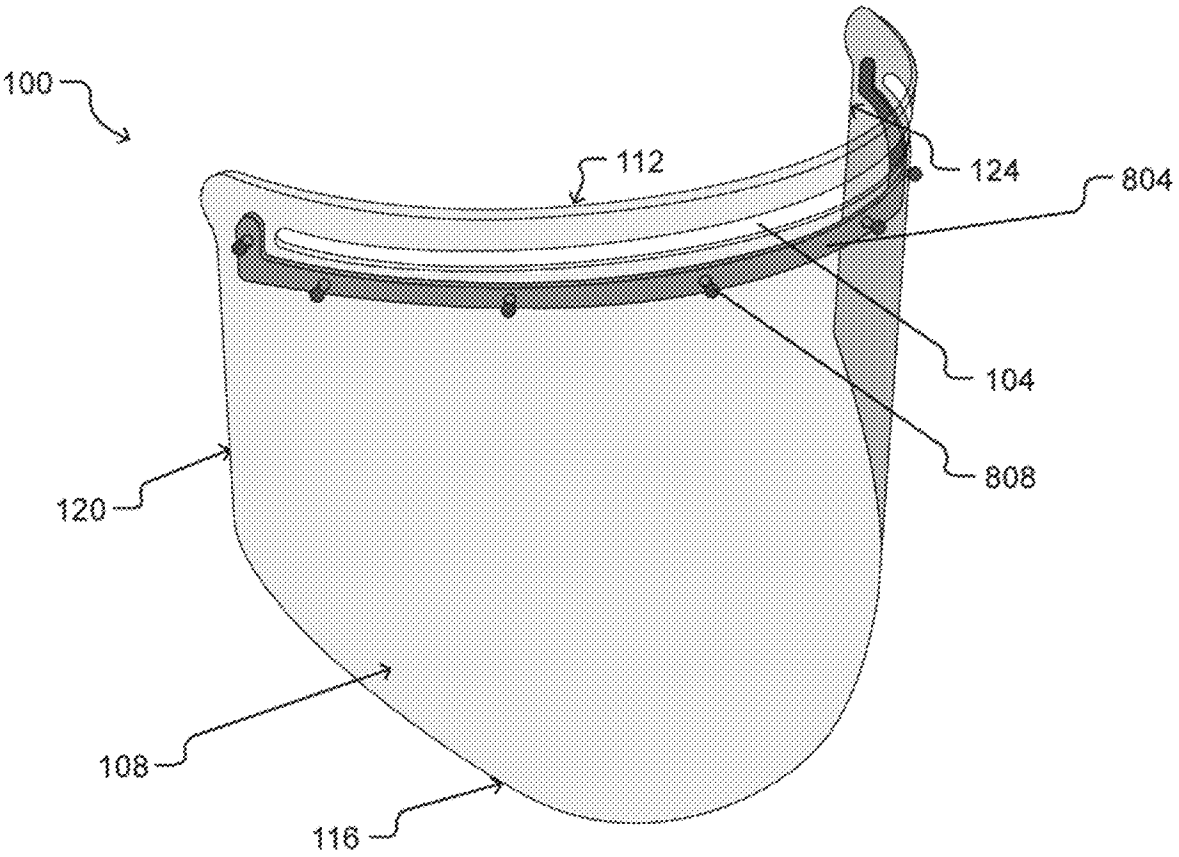
FIG. 8 shows a snap-on strip for the face shield in accordance with embodiments of the present disclosure.

As depicted in FIG. 8, the face shield 100 may comprise a snap-on strip 804. The snap-on strip 804 may attach to the face shield 100, and may be positioned above or below the brim of the hat when the face shield 100 is mounted thereon. In some embodiments, the snap-on strip 804 may be manufactured to a desired amount of curvature. In other words, the snap-on strip 804 may be molded, bent, or otherwise formed to the desired curvature of the transparent material 108. Said another way, the snap-on strip 804, when installed in place by any number of contemplated ways to fix it or attach it to the transparent material 108, may cause the transparent material 108 to curve to and conform with the shape of the snap-on strip 804. This effectively causes the face shield 100 to wrap around the wearer's face. It may also be possible to configure the snap-on strip 804 to snap near the top end 112 of the transparent material 108 between the slot 104 and the top end 112. In some embodiments, the snap-on strip 804 may be provided with a slot that aligns and conforms with the slot 104 such that the snap-on strip 804 can be placed over top of the slot 104, fully surrounding the slot 104 with the corresponding slot formed in the snap-on strip 804. This may allow the transparent material 108 to be manufactured and shipped in the non-worn state (i.e. the transparent material 108 may be shipped in a substantially flat state). In some embodiments, the snap-on strip 804 may begin in a flat state, and may be thermoformed to the desired curvature. The snap-on strip 804 may then attach to the face shield 100 and may conform the transparent material 108 to the curvature of the snap-on strip 804. It should be appreciated that the snap-on strip 804 may be configured to snap or be attached either from the back side or front side of the transparent material 108.

Additionally, the snap-on strip 804 may comprise a plurality of vertical tabs that are positioned proximate the ends of the slot 104. The vertical tabs may extend upward between the slot 104 and the sides 120, 124. The vertical tabs may, in some embodiments, correspond to vertically-oriented portions of the snap-on strip(s) 804 that provide additional slot 104 stability.

The snap-on strips 804 may also include snap posts 808 to provide additional stability to the slot 104. For instance, the plurality of snap posts 808 may provide extra rigidity to the slot 104 to better mount to the brim of the hat. In some embodiments, the slot 104 may possess a bi-stability, where more than one orientation of the slot 104 may form a stable mount with the brim of the hat. In this case, the snap-on strip 804 may reduce the bi-stability to a single stability state, creating a better user experience and a more stable system.

In some embodiments, the snap-on strip 804 may be formed of a conformable material that, once conformed to a desired shape, retains the desired shape without further application of an external force. As an example, the snap-on strip 804 may be formed from a pliable but structurally stable plastic, a bendable metal, or the like. The snap-on strip 804 may be configured to enable the wearer to bend the snap-on strip 804 into the desired shape and then the snap-on strip 804 maintains the curvature formed by the wearer when the snap-on strip 804 is attached to the transparent material 108. The strength of the snap-on strip 804 may be sufficient to retain its shape and to hold the transparent material 108 in the shape formed by the wearer without springing back to its original shape. In some embodiments, the snap-on strip 804 may comprise a higher k-factor than the transparent material 108. In some embodiments, the snap-on strip 804 may comprise metal whereas the transparent material 108 comprises a pliable plastic. As an even more specific, but non-limiting example, the snap-on strip 804 may include an armature wire or could have armature wire over-molded into the strip to give it the desired flex and set characteristics. In some embodiments, the snap-on strip 804 may be provided with one or more vents/slots/holes to enable air passage near the wearer's forehead and above any portion of the wearer's face that may emit spit or mucus.

Figure 9A:
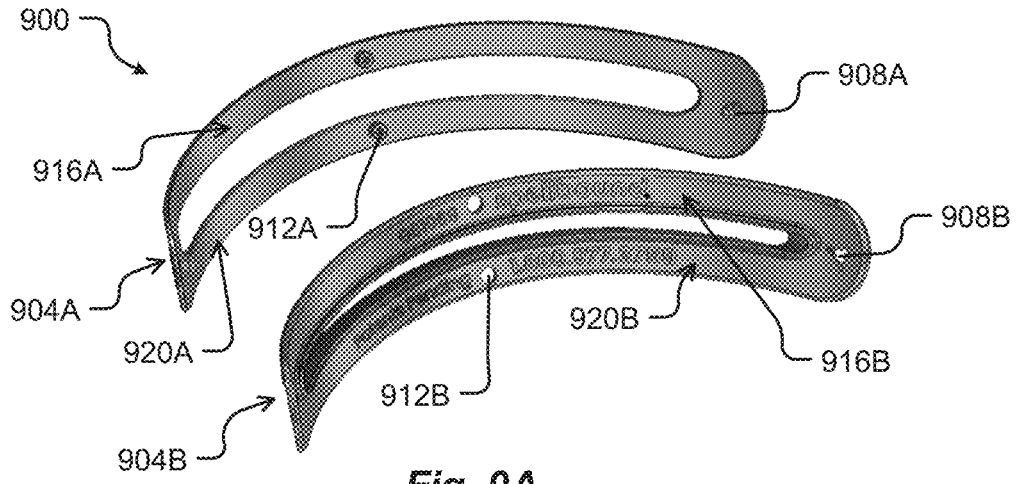
FIGS. 9A-9C show a two part snap-on strip system in accordance with embodiments of the present disclosure.
Figure 9B:
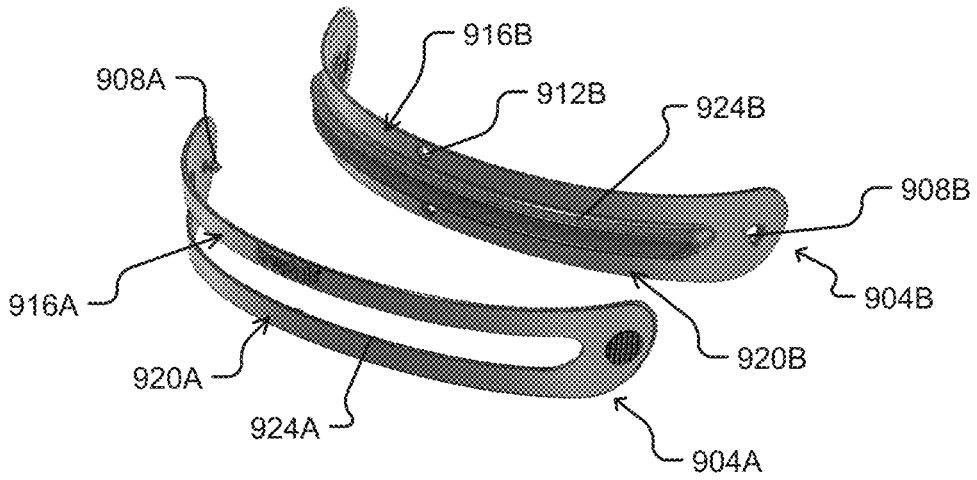
Figure 9C:
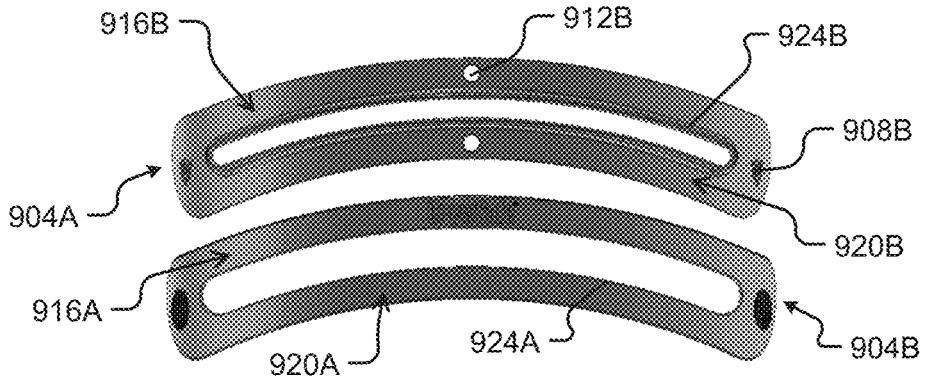

Referring to FIG. 9, the face shield 100 may comprise a two part snap-on strip 900. The two part snap-on strip 900 may comprise two parts: a front strip 904A and a back strip 904B. The front strip 904A may connect to the back strip 904B, with the top end 112 of the transparent material 108 sandwiched therebetween. That is, the front strip 904A may contact a first surface of the transparent material 108, while the back strip 904B may contact a second surface of the transparent material 108 opposite the first surface. This may provide additional stability to the transparent material 108 and may permit the face shield 100 to more easily and more securely mount to the brim of the hat.

The two part snap on strip 900 may be configured to contain portions thereof that are positioned both below and above the slot 104. For example, the front strip 904A may have a top portion 916A and a bottom portion 920A, while the back strip 904B may have a complementary top portion 916B and bottom portion 920B. When the front strip 904A and the back strip 904B are joined, with the top end 112 of the face shield 100 sandwiched therebetween, the top portions 916A, 916B may be located above the slot 104, while the bottom portions 920A, 920B may be located below the slot 104. In other words, the two part snap-on strip 900 may contact both the top and bottom of the brim of the hat when the face shield 100 is mounted thereon.

The front strip 904A may include a method to attach to the back strip 904B. In some embodiments, the front strip 904A may have a connector 908A, which may contact, connect to, or otherwise couple with a complementary connector 908B of the back strip 904B. The method of connection is not particularly limited, and various connective methods may be implemented. Some non-limiting examples include a screw-nut-washer configuration, a threaded fastener, a hook and loop fastener system (e.g., Velcro), or the like. Some embodiments may include additional or alternative methods of connecting the front strip 904A to the back strip 904B. For instance, the front strip 904A may additionally or alternatively include a snap fastener 912A capable of connecting to a complementary snap fastener 912B of the back strip 904B.

In some embodiments, the two part snap-on strip 900 may comprise an extending edge 924B. The extending edge 924B may extend from the back strip 904B toward the front strip 904A, and may interface with a perimeter 924A of the front strip 904A. For instance, upon the coupling of the front strip 904A with the back strip 904B to form the two part snap-on strip 900, the extending edge 924B may extend through the hole formed by the perimeter 924A such that the entirety of the perimeter contacts the extending edge 924B and is positioned therearound. The extending edge 924B may assist in preventing the front strip 904A and/or the transparent material 108 from performing translational movement during the use of the face shield 100.

As depicted in FIGS. 10A-10J, the face shield 100 may comprise a hinged snap-on strip 1000. The hinged snap-on strip 1000 may be configured to attached to the top end 112 of the transparent material 108. The hinged snap-on strip 1000 may comprise a top portion 1004, which may be located above the slot 104, and a bottom portion 1008 located below the slot 104 when the hinged snap-on strip 1000 is attached to the transparent material 108. The hinged snap-on strip 1000 may be positioned on the second surface of the transparent material 108. In other words, a portion of the hinged snap-on strip 1000 may be located between the face of the wearer and the transparent material 108.

The hinged snap-on strip 1000 may comprise a clasp 1012. The clasp 1012 may be attached to the hinged snap-on strip 1000 by a hinge 1014. The hinge 1014 may permit the clasp 1012 to pivot about the hinge 1014, wrap around the two sides 120, 124, and contact the first surface of the transparent material 108. The hinge 1014 may be any material or structure that permits the clasp 1012 from pivoting therearound. In some embodiments, the hinge 1014 may be a living hinge. That is, the hinge 1014 may be the same material as the hinged snap-on strip 1000, but may be thinner, less materially dense, and/or contain one or more cuts/scores such that the hinge 1014 may permit the clasp 1012 to pivot.

Figure 10A:
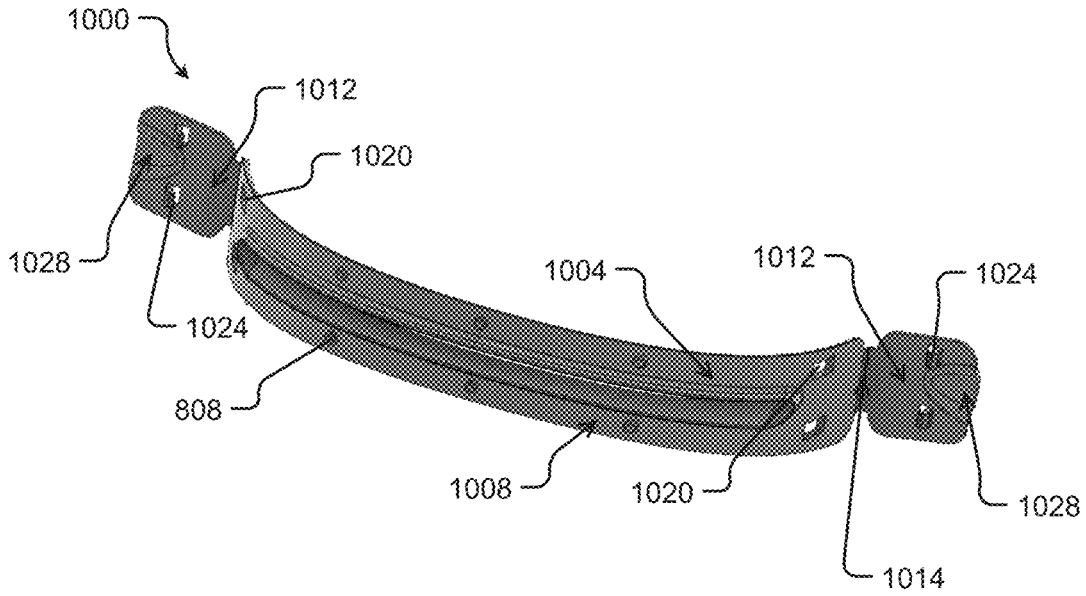
FIGS. 10A-10J show the face shield including a hinged snap-on strip in accordance with embodiments of the present disclosure.
Figure 10B:
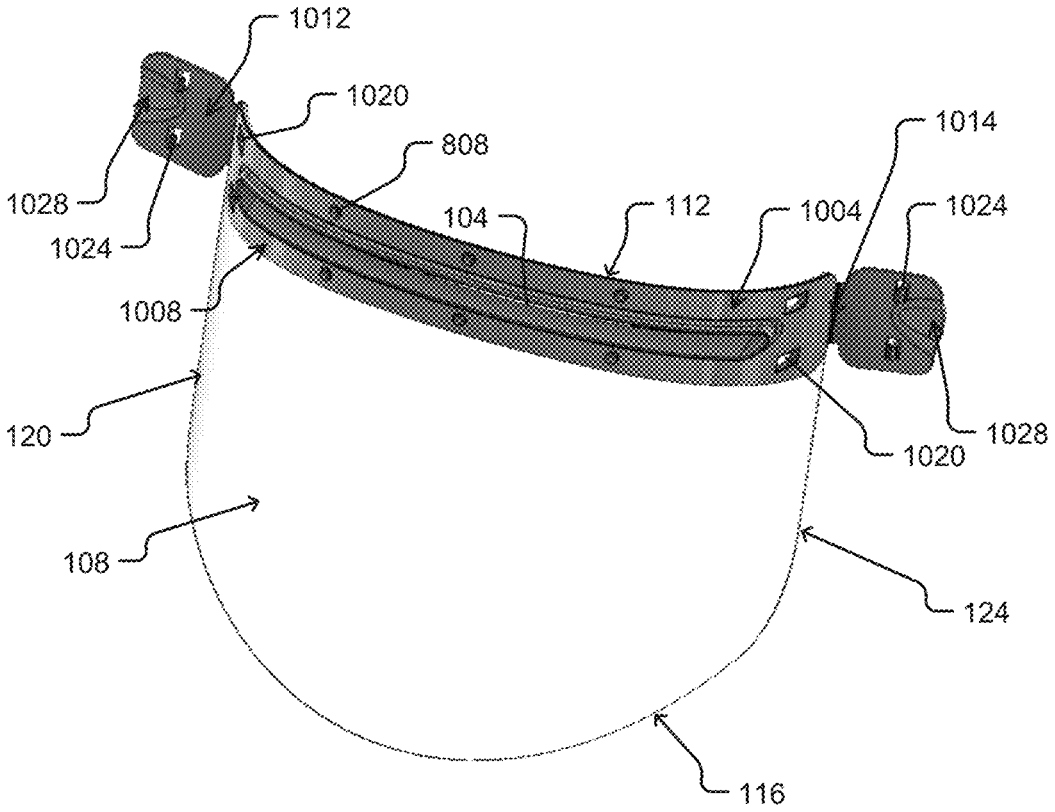
Figure 10C:
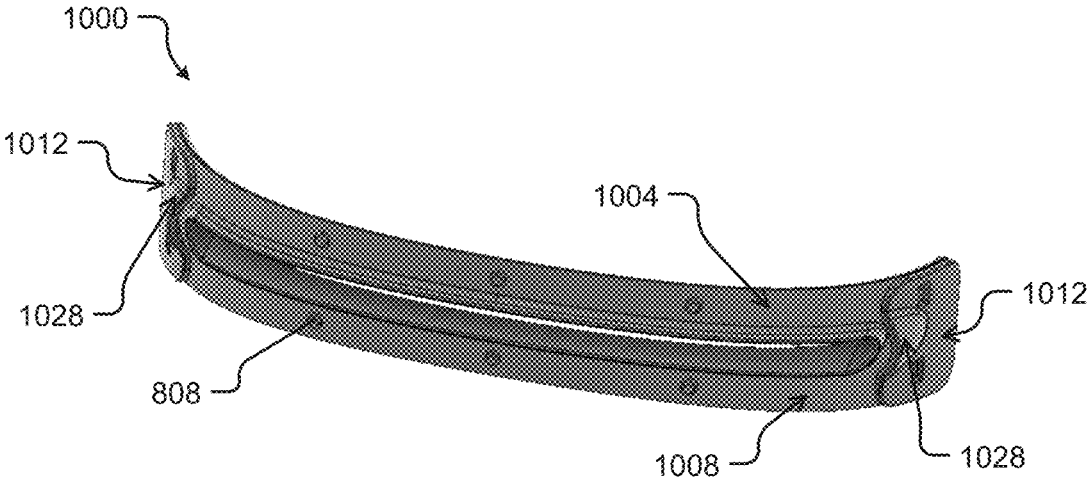
Figure 10D:
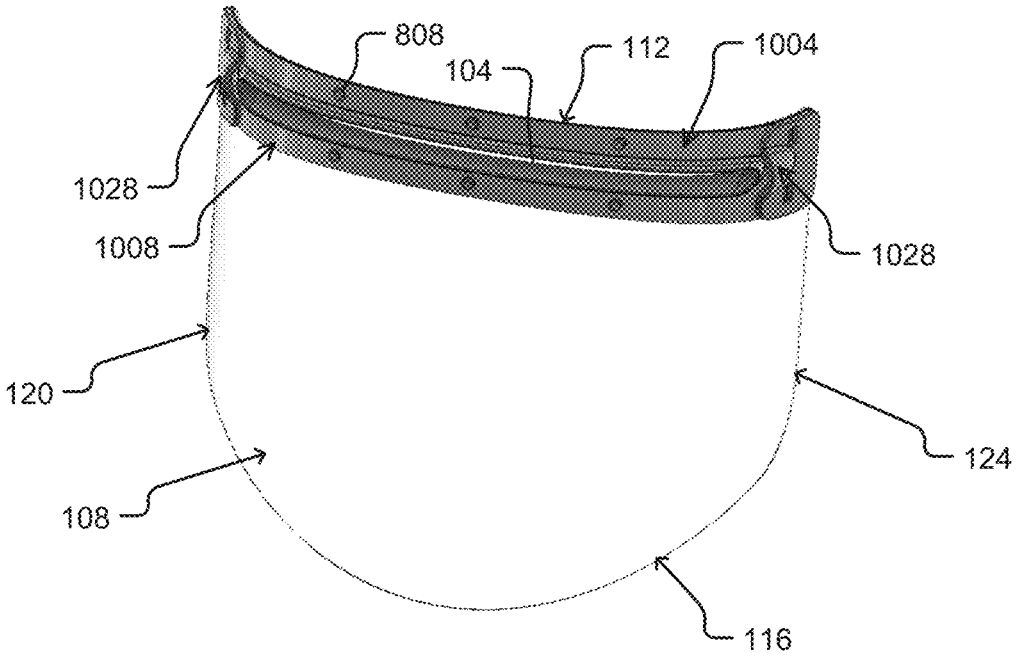
Figure 10F:
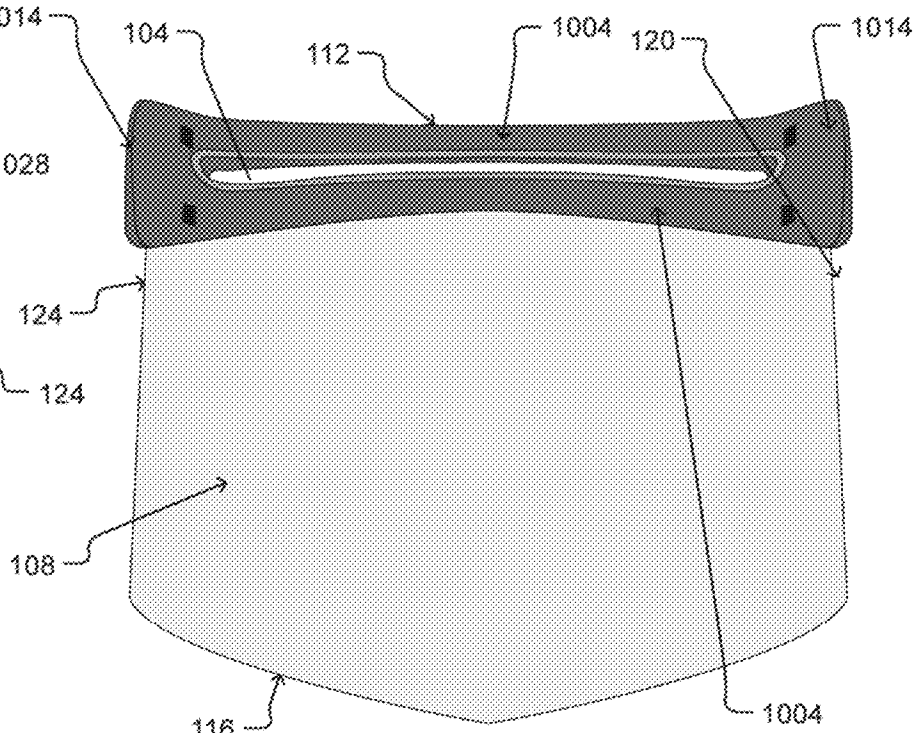
Figure 10E:
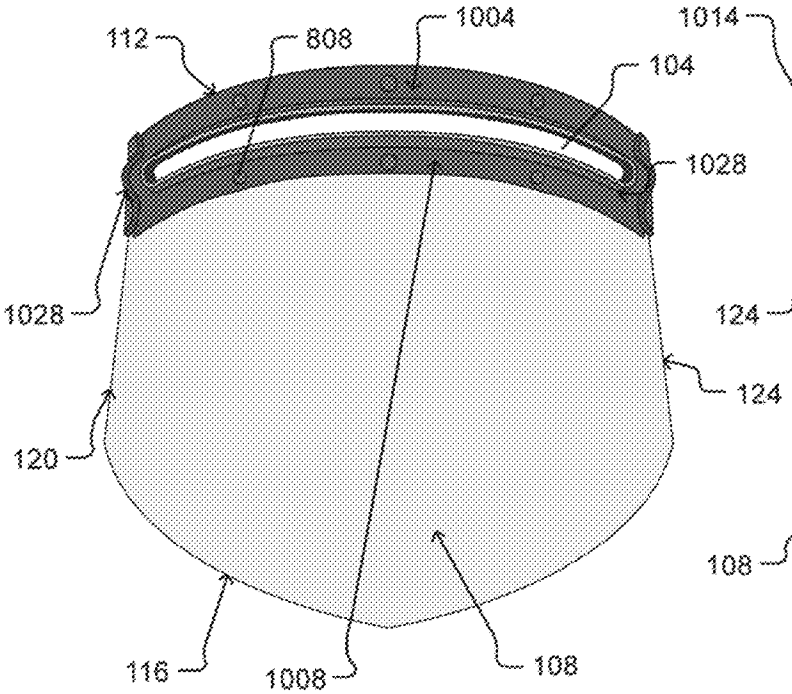
Figure 10H:
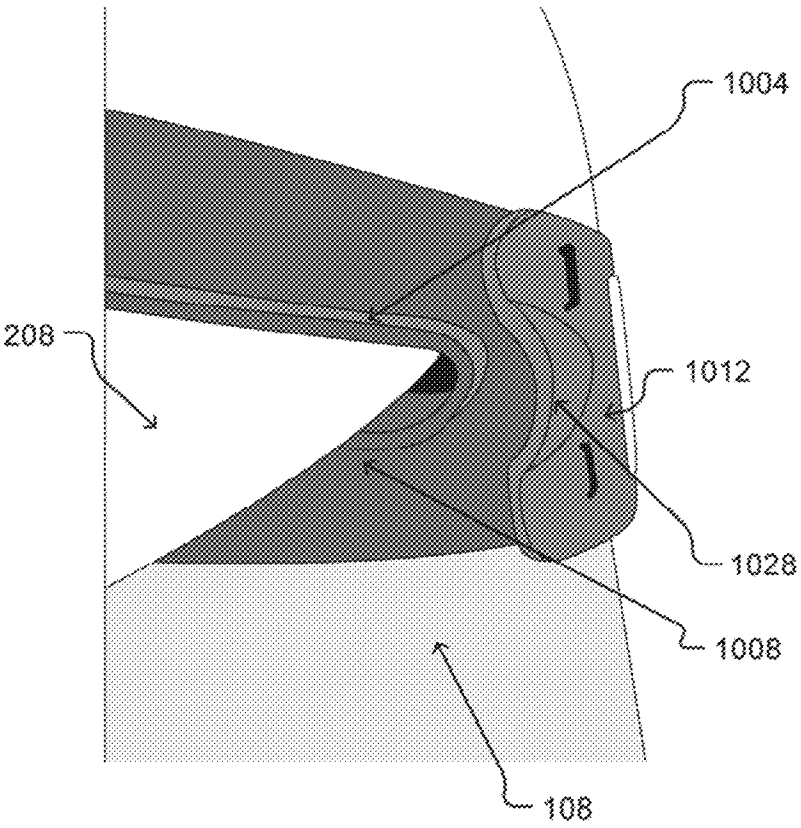
Figure 10G:
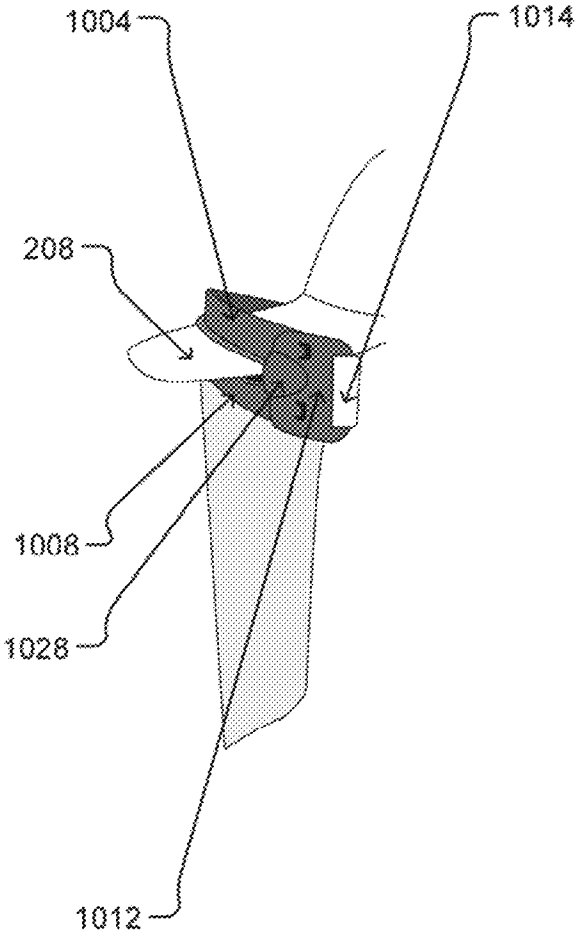
Figure 10J:
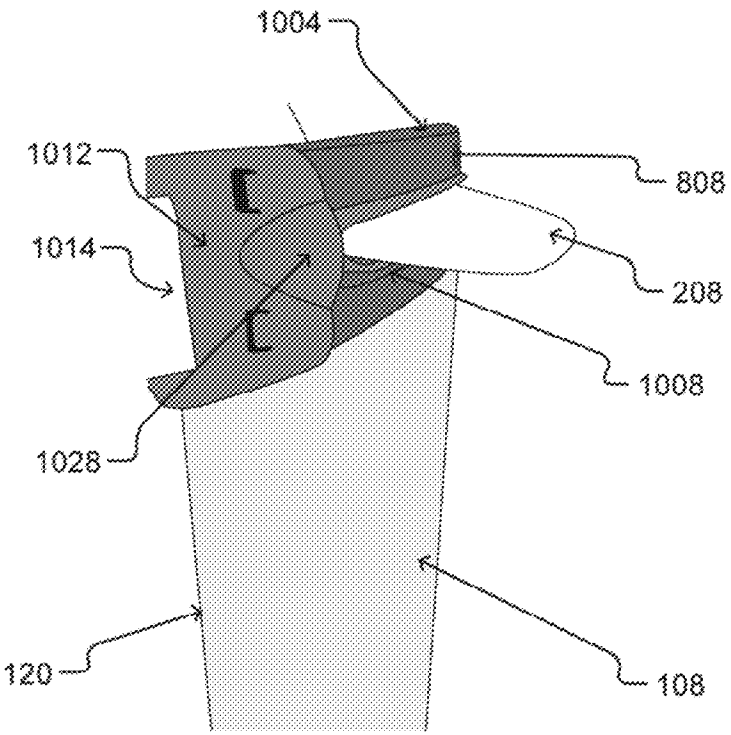
Figure 10I:
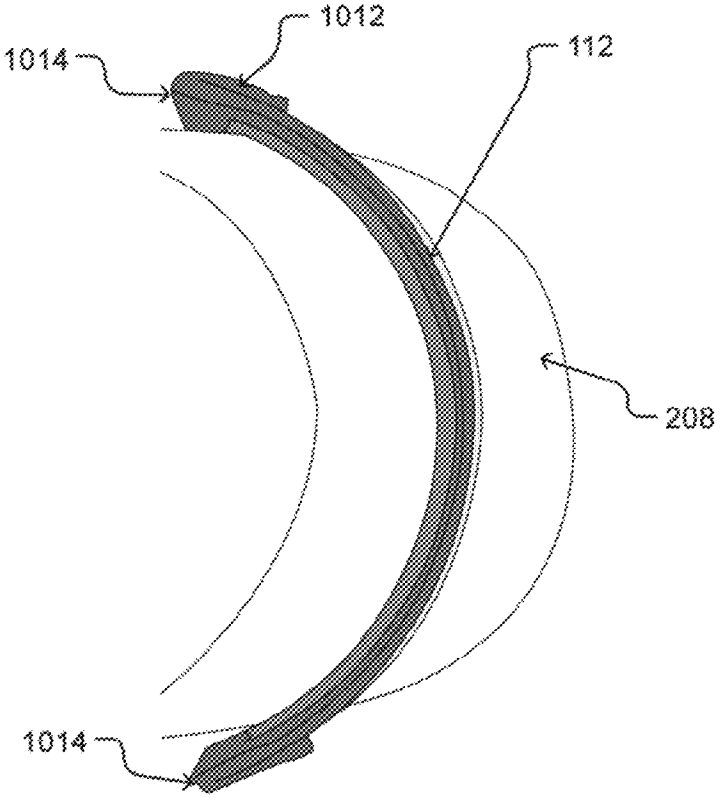

The clasp 1012 may comprise a connection element 1024. The connection element 1024 may permit the clasp 1012 to lock into a fixed position by interfacing with a hole 1020 when the clasp 1012 pivots about the hinge 1014 and contacts the first surface of the transparent material 108. In some embodiments, the connection element 1024 may be fastened to or otherwise interact with the hole 1020 such that the hinged snap-on strip 1000 is securely connected to the top end 112 of the transparent material 108, as depicted in FIGS. 10D-10F. In one embodiment, the clasp 1012 may have one or more connective elements 1024 that may interact with one or more complementary holes 1020.

As illustrated in FIGS. 10C-10J, when the clasp 1012 has pivoted about the hinge 1014 such that the clasp 1012 contacts the first surface of the transparent material 108, the connection element 1024 may interact with the hole 1020 to form a connection. When the connection is formed, a portion or all of the clasp 1012 may wrap around the two sides 120, 124 to hold the transparent material 108 securely in place. The connection may prevent the clasp 1020 from pivoting away from the first surface of the transparent material 108. In some embodiments, the transparent material 108 may contain one or more holes, slots, and/or gaps to permit the holes 1020 to interact with the connection element 1024 after the clasp 1012 has pivoted about the hinge 1014. The face shield 100 may then be mounted on the brim the hat.

The hinged snap-on strip 1000 may comprise a release tab 1028. In some embodiments, the release tab 1028 may allow the wearer to terminate the connection between the connection element 1024 and the hole 1020. The release tab 1028 may require an input of a minimum amount of force to successfully separate the connection element 1024 from the hole 1020. For example, the wearer may wish to remove the hinged snap-on strip 1000 from the transparent material 108, and may need to input the minimum amount of force to the release tab 1028 in order to successfully disconnect the hole 1020 and the connection element 1024 and allow the clasp 1012 to pivot away from the first surface of the transparent material 108 about the hinge 104. In some embodiments, the transparent material 108 may then be entirely disconnected from the hinged snap-on strip 1000, allowing the wearer to remove, replace, and/or substitute the transparent material

108. For example, the transparent material 108 may be damaged, and may need replacement. In this case, the wearer may apply the required minimum amount of force to the release tab 1028 and effectively pivot the clasp 1012 away from the first surface of the transparent material 108. This may then allow the wearer to replace the transparent material 108. Once replaced, the wearer may then pivot the clasp 1012 about the hinge 1014 such that the connection element 1024 and the hole 1020 form a connection, resulting in the new transparent material 108 being securely connected with the hinged snap-on strip 1000.

Additionally or alternatively, the face shield 100 may comprise a health screening system. The health screening system may comprise an artificial intelligence (AI) program and one or more sensors that are capable of collecting data from an environment about the face shield 100 or from a wearer of the face shield 100. The sensors may include biometric sensors, heat sensors, temperature sensors, accelerometers, microphones, pressure sensors, or combinations thereof. The AI program may receive inputs from one or multiple sensors and perform data analysis about the overall health of the wearer based on the sensor data. In some embodiments, the AI program may collect data related to biological indicators associated with the wearer, perform data analysis for the biological indicators, and provide a report based at least in part on the data analysis of the biological indicators. As a non-limiting example, the health screen system may monitor the health of the wearer by recording the heartbeat, the temperature, the blood pressure, combinations thereof, and/or the like. This list is not exhaustive, and additional or alternative biological or non-biological indicators may be recorded or detected by the health screening system. The health screen system may send the recorded data to the AI program, which may then perform data analysis to determine if any of the recorded measurements fall outside the normal range of the user. In some embodiments, the AI program may compare recently recorded data to historic user data to determine any significant variation therefrom.

In some embodiments, the AI program may provide the analysis to the health screening system, which may, in the event the biological indicators have deviated from normal readings, generate a report of the analysis. A processor and memory configured to provide the AI program may be mounted to the face shield 108 by way of attaching to the transparent material 108, attaching to the snap-on strip 804, or a combination thereof. In some embodiments, the processor and memory providing the AI program may be powered by an external power source (e.g., batteries, solar power source, etc.) and the external power source may also be mounted to the transparent material 108, the snap-on strip 804, or a combination thereof. In some embodiments, the power source may be provided on one of the transparent material 108 and snap-on strip 804 and then the processor and memory may be provided on the other of the transparent material 108 and snap-on strip 804. In this configuration, when the transparent material 108 is physically connected with the snap-on strip 804 an electrical contact between the transparent material 108 and snap-on strip 804 may connect and enable power to be provided from the power source to the processor and memory. Similar to the processor and memory that provide the AI program, the sensors of the health screen system may also be powered by the external power source. Further still, any other electrical component (e.g., microphone, light, communication apparatus, etc.) may be configured to receive power from the external power source. The health screening system may be configured to be capable of sending the report over a communication network. In one embodiment, the health screen system may be embedded in the snap-on strip 804, any other snap-on strip, and/or any other system capable of being attached to the transparent material 108 mentioned herein.

As a non-limiting example, the wearer may be an employee of a retailer, and may be feeling ill. The wearer may have an elevated temperature and may be perspiring at a rate greater than normal. The health screen system may be equipped with sensors that detect the elevated temperature and increased perspiration, and may send the data to the AI program, which performs an analysis and determines that the wearer has a fever. The AI program may send the analysis to the health screening system, which may then generate a report indicating the wearer has a fever. The health screening system may send this report over a communication network to the employee's supervisor, who may then take appropriate action.

Figure 11B:
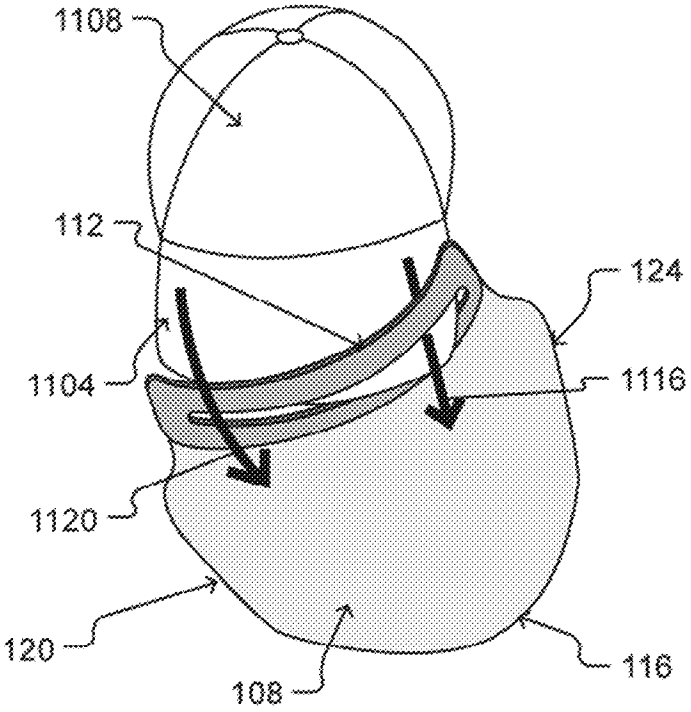
FIGS. 11A-11D show a method of mounting the face shield on the head-mounted apparatus in accordance with embodiments of the present disclosure.
Figure 11A:
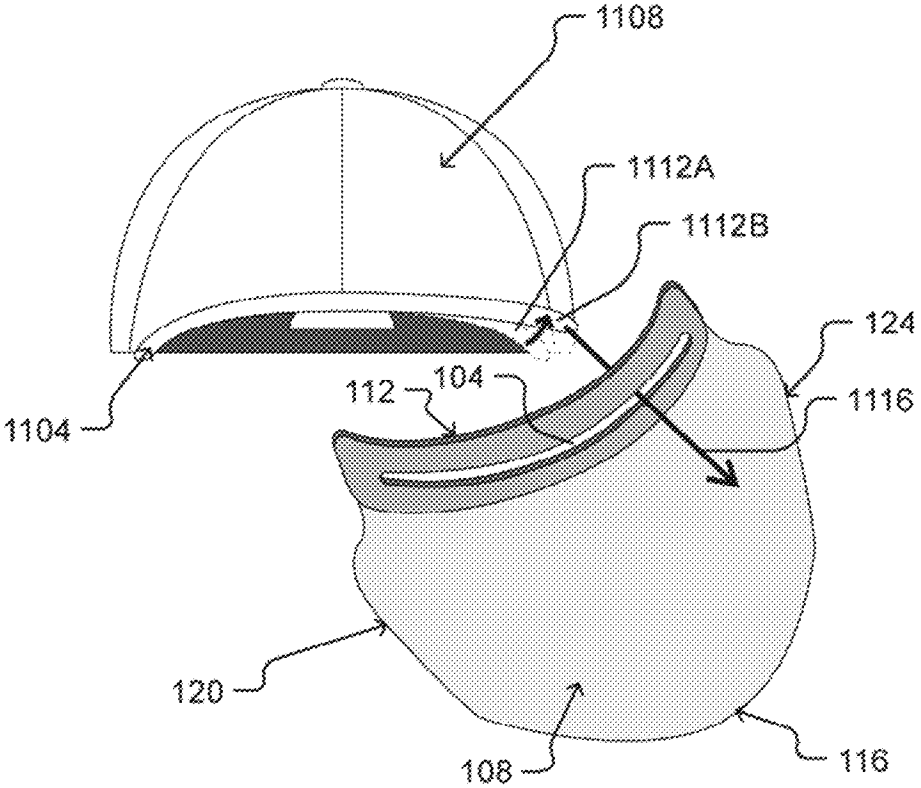
Figure 11D:
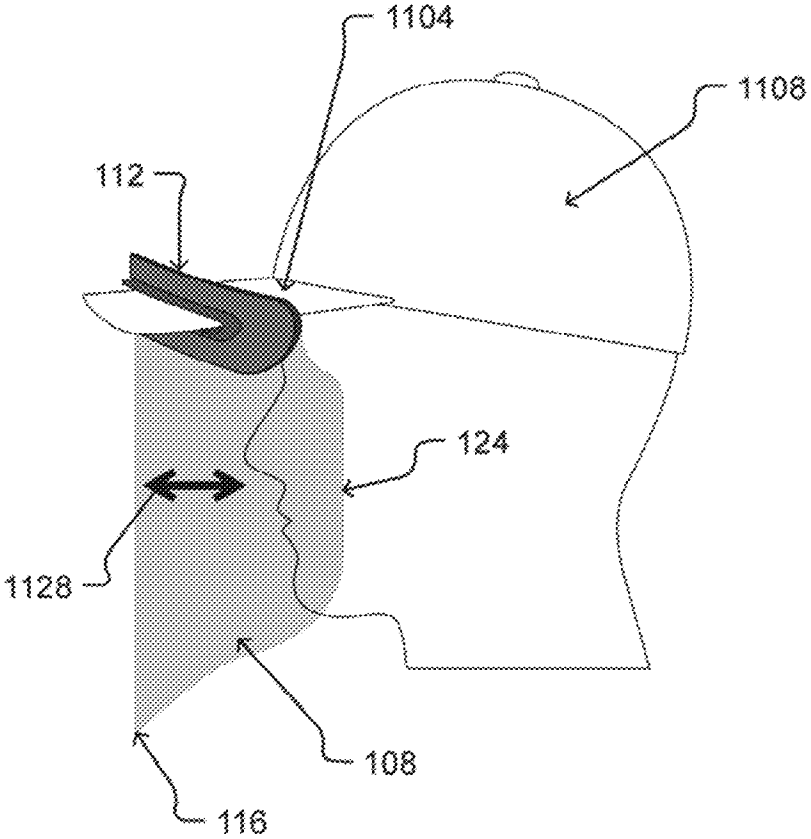
Figure 11C:
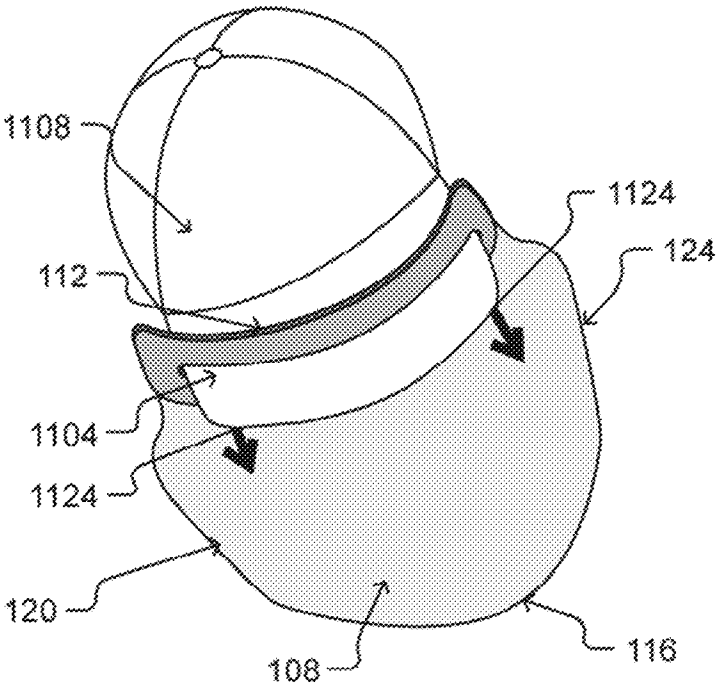

FIGS. 11A-11D depicts a method for mounting the face shield 100 on the brim 1104 of a hat 1108. In one embodiment, a portion of the brim 1104 is flexed from an unflexed state 1112A to a flexed state 1112B. The flexed state 1112B may permit the brim 1104 to more easily slide through the slot 104. Upon entering the flexed state 1112B, the portion of the brim 1104 in the flexed state may then be slid through the slot 104, as indicated by an arrow 1116. FIG. 11B then illustrates the continuation of the method, where the remainder of the brim 1104 is maneuvered through the slot 104, as shown by an arrow 1120. Once the brim 1104 of the hat 1108 has been fully inserted into the slot 104, the depth of the brim 1104 may be further adjusted, as noted in FIGS. 11C and 11D. The wearer may adjust the face shield 100 on the brim 1104 of the hat 1108 such that the brim 1104 further descends through the slot 104 as noted by arrows 1124, which may move the face shield 100 closer to the wearer. As previously mentioned, the face shield 100 may be flexible, and may conform to the brim 1104 of the hat 1108. The wearer may also be able to further adjust the distance between the face shield 100 and the face of the wearer, as denoted by two-way arrow 1128. For instance, the wearer may desire the face shield 100 closer to the face of the wearer and may move the face shield 100 along the brim 1104 so as to position the face shield 100 closer to the face of the wearer. Additionally or alternatively, the wearer may decide to move the face shield 100 further away from the wearer and may slide the face shield 100 along the brim 1104 such that the face shield 100 moves away from the face of the user.

Any of the steps, functions, and operations discussed herein can be performed continuously and automatically.

The illustrative systems and methods of this disclosure have been described in relation to a face shield. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

Embodiments include a face shield comprising: a slot capable of sliding around a brim of a head covering; and a curved surface.

Aspects of the above face shield include an anti-microbial coating.

Aspects of the above face shield include a substantially transparent material, the substantially transparent material comprising a curved edge, wherein the curved edge curves toward a user of the face shield.

Aspects of the above face shield include that the curved surface comprises a light protection coating, wherein the light protection coating filters light passing through a first side of the face shield.

Aspects of the above face shield include that the curved surface comprises a coating that improves light transmission and visibility.

Aspects of the above face shield include that the curved surface comprises a chemically resilient coating.

Aspects of the above face shield include that the curved surface comprises a coating providing a prescription level visual improvement for a wearer of the hat.

Aspects of the above face shield include that the curved surface comprises a protective coating such that the curved surface is resistant to scratching, cracking, and breaking.

Aspects of the above face shield include that the curved surface comprises a fireproof coating.

Aspects of the above face shield include that the curved surface comprises an anti-microbial coating.

Aspects of the above face shield include that the anti-microbial coating neutralizes bacteria, viruses, fungi, yeasts, molds, parasites, and toxins.

Aspects of the above face shield include that the curved surface comprises an anti-fog coating preventing the curved surface from becoming fogged with condensation.

Aspects of the above face shield include that the curved surface comprises an electrically conductive coating.

Aspects of the above face shield include that the electrically conductive coating comprises one or more semiconductive regions.

Aspects of the above face shield include that the electrically conductive coating comprises a photodetector and photoreceptor.

Aspects of the above face shield include that the electrically conductive coating is thermally sensitive to changes in temperature.

Aspects of the above face shield include that the electrically conductive coating comprises a gas sensor.

Aspects of the above face shield include that the electrically conductive coating comprises a heads-up display (HUD).

Aspects of the above face shield include that the light is ultraviolet light.

Aspects of the above face shield include that the curved surface further comprises a portal, wherein the portal comprises a microphone that passes sound from a first side of the face shield to a second side of the face shield.

Aspects of the above face shield include that the curved surface further comprises:

a protective coating, wherein the protective coating provides protection from structural damage.

Aspects of the above face shield include that protective coating is fireproof and possesses a high heat capacitance.

Aspects of the above face shield include that the curved surface further comprises:

a ventilation system, wherein the ventilation system vents air from a first side of the face shield to a second side of the face shield opposite the first side of the face shield.

Embodiments include a method for protecting a face of a user, the method comprising:

providing, to a head-mounted apparatus, a face shield, wherein the face shield comprises a slot capable of sliding around a brim of the head-mounted apparatus and a curved surface covering at least a portion of the face of the user.

Aspects of the above method include that the face shield further comprises: an anti-microbial coating.

Aspects of the above method include that the face shield further comprises: a curled edge extending along at least a portion of a distal end of the face shield opposite the slot, wherein the curled edge curves toward the user of the face shield.

Aspects of the above method include that the face shield further comprises: a light protection coating, wherein the light protection coating filters light passing through a first surface the face shield.

Aspects of the above method include that the light is ultraviolet light.

Aspects of the above method include that the face shield further comprises: a portal, wherein the portal comprises a microphone capable of transmitting sound between a first surface of the face shield and a second surface of the face shield.

Aspects of the above method include that the face shield further comprises: a protective coating, wherein the protective coating is fireproof and further provides structural resilience to the face shield.

Aspects of the above method include that the face shield further comprises: a ventilation system, wherein the ventilation system vents air near a first surface of the face shield to a second surface of the face shield opposite the first surface of the face shield.

Aspects of the above method include that the ventilation system comprises a sensor, wherein the sensor determines the concentration of carbon dioxide near the first surface of the face shield and, when the concentration of carbon dioxide is above a first threshold, vents the air to the second surface of the face shield.

Embodiments include an apparatus comprising: a head-mounting device; and a face shield, wherein the face shield comprises a slot configurable to slide over a horizontal extension of the head-mounting device and an arched surface.

Aspects of the above apparatus include that the arched surface comprises an angled edge extending at least partially along a first trajectory on the arched surface, wherein the slot extends at least partially along a second trajectory on the arched surface, and wherein the first trajectory and the second trajectory are parallel.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A face shield configured to interface with and be supported by a brim of a hat, the face shield comprising:

a snap-on strip including a slot; and a transparent sheet of material, wherein the snap-on strip is connectable to the transparent sheet of material and configured to impart a shape to the transparent sheet of material when connected thereto, wherein at least one of the snap-on strip and the transparent sheet of material comprise one or more attachment mechanisms, wherein the one or more attachment mechanisms comprise:

a front strip; and a back strip, wherein the front strip contacts a first surface of the transparent sheet of material, wherein the back strip contacts a second surface of the transparent sheet of material, wherein the front strip releasably connects to the back strip, wherein the front strip and back strip form the slot when the front strip is releasably connected to the back strip, wherein the transparent sheet of material comprises a slot, and wherein the slot of the snap-on strip aligns with the slot of the transparent sheet of material when the snap-on strip is connected to the transparent sheet of material.

2. The face shield of claim 1, wherein the transparent sheet of material is completely supported by the brim of the hat when the brim is inserted through the slot, and wherein the slot extends almost completely between two sides of the transparent sheet of material and is substantially proximate to a top end of the transparent sheet of material.

3. The face shield of claim 1, wherein the transparent sheet of material comprises the one or more attachment mechanisms.

4. The face shield of claim 1, wherein the one or more attachment mechanisms comprise at least two clasps, wherein each clasp comprises a hinge and a pivotable component, wherein the hinge is connected to the pivotable component, wherein the pivotable component is configured to wrap around the transparent sheet of material, and wherein the at least two clasps provide a locking mechanism such that the snap-on strip attaches to the transparent sheet of material when the pivotable component wraps around the transparent sheet of material.

5. The face shield of claim 1, wherein the snap-on strip is releasably connectable to the transparent sheet of material, wherein the snap-on strip is pre-curved and configured to attach to the transparent sheet of material thereby causing the transparent sheet of material to conform with a shaped curvature of the snap-on strip.

6. The face shield of claim 1, wherein the snap-on strip reinforces the transparent sheet of material.

7. The face shield of claim 1, wherein the snap-on strip comprises the one or more attachment mechanisms.

8. The face shield of claim 1, wherein the front strip comprises a first connector, wherein the back strip comprises a second connector, and wherein the first connector and the second connector form a snap fastener.

* * * * *